US008853961B2

(12) United States Patent
Terashima

(10) Patent No.: US 8,853,961 B2
(45) **Date of Patent: *Oct. 7, 2014**

(54) DISCHARGE LAMP LIGHTING DEVICE, PROJECTOR, AND DRIVING METHOD OF DISCHARGE LAMP

(75) Inventor: Tetsuo Terashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 574 days.

This patent is subject to a terminal disclaimer.

(21) Appl. No.: 13/209,850

(22) Filed: Aug. 15, 2011

(65) Prior Publication Data

US 2012/0043904 A1 Feb. 23, 2012

(30) Foreign Application Priority Data

Aug. 20, 2010 (JP) ..... 2010-184762

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |
| ***H05B 41/292*** | (2006.01) |
| *H05B 41/16* | (2006.01) |
| *H05B 41/24* | (2006.01) |
| *H01J 13/48* | (2006.01) |
| *H01J 15/04* | (2006.01) |
| *H01J 17/36* | (2006.01) |

(52) U.S. Cl.

CPC ..... *H05B 41/2928* (2013.01)
USPC ..... 315/291; 315/246; 315/326

(58) Field of Classification Search

None
See application file for complete search history.

(56) References Cited

U.S. PATENT DOCUMENTS

| | | | | |
|---|---|---|---|---|
| 4,912,374 | A * | 3/1990 | Nagase et al. | 315/244 |
| 7,023,144 | B2 | 4/2006 | Suzuki et al. | |
| 7,170,237 | B2 | 1/2007 | Suzuki et al. | |
| 8,203,280 | B2 | 6/2012 | Yamauchi et al. | |
| 2008/0116820 | A1 | 5/2008 | Ozasa et al. | |
| 2010/0007281 | A1 * | 1/2010 | Feng et al. | 315/169.1 |
| 2010/0103388 | A1 | 4/2010 | Yamauchi et al. | |
| 2010/0123406 | A1 | 5/2010 | Soma et al. | |
| 2010/0128232 | A1 | 5/2010 | Kagata et al. | |
| 2011/0012524 | A1 | 1/2011 | Terashima | |
| 2011/0012525 | A1 | 1/2011 | Terashima | |
| 2011/0018456 | A1 | 1/2011 | Terashima | |

FOREIGN PATENT DOCUMENTS

| | | | |
|---|---|---|---|
| CN | 101057529 | A | 10/2007 |
| JP | 1-112698 | A | 5/1989 |
| JP | 01-217893 | A | 8/1989 |
| JP | 2003-59684 | A | 2/2003 |

(Continued)

*Primary Examiner* — Douglas W Owens
*Assistant Examiner* — Dedei K Hammond
(74) *Attorney, Agent, or Firm* — ALG Intellectual Property, LLC

(57) ABSTRACT

In at least one embodiment of the disclosure, a discharge lamp lighting device includes a discharge lamp driving section that drives a discharge lamp and a control unit that controls the discharge lamp driving section. The control unit alternately performs a first-interval DC driving process and a first-interval AC driving process in a first interval, alternately performs a second-interval DC driving process and a second-interval AC driving process in a second interval other than the first interval, and changes a length of at least one of a period during which the first-interval DC driving process is performed and a period during which the second-interval DC driving process is performed so as to be shortened in a stepped manner within a predetermined sub-interval.

15 Claims, 11 Drawing Sheets

(56) References Cited

FOREIGN PATENT DOCUMENTS

| | | | |
|---|---|---|---|
| JP | 2006-59790 | A | 3/2006 |
| JP | 2006-332015 | A | 12/2006 |
| JP | 2007-280734 | A | 10/2007 |
| JP | 2010-102930 | A | 5/2010 |
| JP | 2010-118305 | A | 5/2010 |
| JP | 2011-23154 | A | 2/2011 |
| JP | 2011-23288 | A | 2/2011 |
| JP | 2011-28943 | A | 2/2011 |

* cited by examiner

DISCHARGE LAMP LIGHTING DEVICE, PROJECTOR, AND DRIVING METHOD OF DISCHARGE LAMP

CROSS-REFERENCE

The present application claims priority from Japanese Patent Application No. 2010-184762 filed on Aug. 20, 2010 which is hereby incorporated by reference in its entirety.

BACKGROUND

Discharge lamps, such as high-pressure mercury lamps or metal halide lamps, have been used as light sources of a projector. In these discharge lamps, the shape of an electrode changes due to a drop in fusibility resulting from consumption of the electrode by discharge or progress of crystallization of the electrode according to an increase in cumulative lighting time. In addition, when a plurality of projections grows in an electrode tip end portion or irregular consumption of the electrode body progresses in accordance with the change in the shape of the electrode, the arc origin moves or the arc length (a length between electrodes) changes. Such phenomena are not desirable because they reduce the luminance of a discharge lamp or cause a flicker phenomenon so that the lifespan of the discharge lamp is reduced.

In an effort to solve the problem, a discharge lamp lighting device driving a discharge lamp using an alternating current that is an alternating current having a stationary frequency into which an alternating current having a frequency lower than the stationary frequency may be inserted (see, for example, JP-A-2006-59790). In addition, a discharge lamp lighting device that supplies a driving current, in which a direct current is intermittently inserted in a high-frequency alternating current, to a discharge lamp is known (see, for example, JP-A-1-112698).

However, in JP-A-2006-59790, there is no change in the method of inserting an AC current having a low frequency, and fine control cannot be performed. In addition, in JP-A-1-112698, only a direct current is intermittently inserted into an alternating current having a high frequency, and the length of the inserted DC component is not finely controlled. Accordingly, there are problems in that the deformation of the electrode projections cannot be sufficiently suppressed, and blackening may occur depending on the state. Therefore, enhancement of the maintenance of the shape of the projections on the tip end portion of the electrode is needed.

SUMMARY

In accordance with certain embodiments of the disclosure, it is possible to provide a discharge lamp lighting device, a method of controlling a discharge lamp lighting device, and a projector capable of preventing the degradation of light emitting characteristics through maintenance of the transformed shape of the electrode projections by performing driving control that is configured by stepwise sequences in consideration of the fusibility of the electrode projections in the tip ends of the electrodes.

According to an aspect of the disclosure, there is provided a discharge lamp lighting device including a discharge lamp driving section that drives a discharge lamp by supplying a driving current to the discharge lamp, and a control unit that controls the discharge lamp driving section. The control unit alternately performs a first DC driving process and a first AC driving process in a first interval, alternately performs a second DC driving process and a second AC driving process in a second interval other than the first interval, controls a first DC current that is configured by a first polarity component starting from a first polarity so as to be supplied as the driving current in the first DC driving process, controls a first AC current that repeats the first polarity component and a second polarity component so as to be supplied as the driving current in the first AC driving process, controls a second DC current that is configured by the second polarity component starting from the second polarity so as to be supplied as the driving current in the second DC driving process, controls a second AC current that repeats the first polarity component and the second polarity component so as to be supplied as the driving current in the second AC driving process, changes a length of at least one of a period during which the first DC driving process is performed and a period during which the second DC driving process is performed to be shortened in a stepped manner by time, and changes a frequency of the first AC current or the second AC current after the performance of the DC driving process.

The first DC current may be configured by a plurality of current pulses of the first polarity component, and the second DC current may be configured by a plurality of current pulses of the second polarity component.

According to certain embodiments of the discharge lamp lighting device, at least one of the length of the period during which the first DC driving process is performed and the length of the period during which the second DC driving process is performed is changed to be shorter in accordance with the time. Accordingly, the degree of fusion in the electrode projection of the discharge lamp is limited in a stepped manner. Through this operation, the DC period is lengthened, and thereafter, by driving using an AC current, the base of a large projection is formed. Then, the length of the DC period is shortened so as to decrease the fused area, and the projection in that portion is grown in accordance with the AC current supplied thereafter.

In addition, the frequency of the AC current applied after the DC driving process is adjusted in accordance with the state of the electrodes, particularly, estimated fusibility of the electrode projections. Finally, the tip end is grown in accordance with the AC current supplied after a shortest DC inserting period. By repeating a fusion-stretching cycle of the electrode projections in a stepped manner by performing such a driving process, electrode projections having a good shape can be formed and maintained while the blackening of the luminous tube due to excessive fusion of the electrodes is suppressed.

In certain embodiments of this discharge lamp lighting device, the control unit may change the period during which the first DC driving process is performed and the period of the DC driving process in the second DC driving process to be relatively shortened, and change the frequency of the first AC current or the second AC current to be relatively increased in correspondence with the change in the DC driving process from a long period to a short period after the period of the DC driving process.

In such a case, the length of the period during which the DC driving process is performed is shortened in a stepped manner in accordance with the elapse of time. In addition, after the period of a relatively long DC driving process, an AC current having a relatively low frequency is supplied, and, after the period of a relatively short DC driving process, an AC current having a relatively high frequency is supplied. The AC driving process, in which the frequency is changed in a stepped manner, is performed such that the projections are enlarged in accordance with an appropriately low frequency, and the calescence point is acquired in accordance with a high frequency. Accordingly, an excessively long DC driving process or an AC driving process using a low frequency is not performed, whereby the electrode projections having a good shape can be formed and maintained while the blackening of the luminous tube is more effectively prevented.

In certain embodiments of this discharge lamp lighting device, the control unit, in accordance with the degraded state of the electrodes of the discharge lamp, after at least one period of the DC driving process of the period during which the first DC driving process is performed and the period during which the second DC driving process is performed in the first and the second intervals, may change the first AC current or the second AC current in a stepped manner from a relatively high frequency to a relatively low frequency in response to the change in the DC driving process from a long period to a short period.

In a case where the electrodes are degraded, although the blackening accompanied with the evaporation of electrode components such as tungsten due to excessive fusion of the tip end portion of the electrode decreases from the initial state, the electrode projections cannot be easily fused, and the calescence point is destabilized. On the contrary, according to this discharge lamp lighting device, after the calescence point is acquired by increasing the frequency of the AC current immediately after the period during which the first DC driving process is performed and the period during which the second DC driving process is performed, the DC driving process is performed, and the frequency of the AC current supplied thereafter is changed in a stepped manner so as to be supplied at low frequency. By repeating such control, even in a state in which the electrodes are degraded, the calescence point is stabilized so as to form relatively large projections, whereby the deformation of the electrodes can be suppressed.

In certain embodiments of the discharge lamp lighting device, the control unit may change the lowest frequency of at least one of the first AC current and the second AC current after at least one period of the DC driving process of the period during which the first DC driving process is performed and the period during which the second DC driving process is performed in the first and second intervals so as to be increased in accordance with the degraded state of the electrodes of the discharge lamp.

In a case where the electrodes are degraded, the electrode projections cannot be easily fused as described above, and accordingly, in a case where the frequency of the AC current in the AC driving process is low, the projections are flattened, and flicker may easily occur. According to this discharge lamp lighting device, after the period of the DC driving process, the lowest frequency of at least one of the first AC current and the second AC current increases. Accordingly, after the tip ends of the electrodes are fused by performing a relatively long DC driving process, the current is switched to an AC current having a frequency higher than that before degradation, and accordingly, discharging is performed without flattening the projections. Therefore, the electrode projections are maintained, and an increase in the distance between the electrodes is suppressed, and the flicker phenomenon can be suppressed.

In certain embodiments of the discharge lamp lighting device, the control unit may change a period during which driving is performed at a lowest frequency of at least one of the first AC current and the second AC current so as to be decreased in accordance with the degraded state of the electrodes of the discharge lamp, after the period of the DC driving process of at least one of the period during which the first DC driving process is performed and the period during which the second DC driving process is performed in the first and second intervals.

In a case where the electrodes are degraded, the tip ends of the electrodes cannot be easily fused, and accordingly, the electrode projections cannot be easily fused as described above. Thus, in a case where the frequency of the AC current in the AC driving process is low, the projections are flattened, and flicker may easily occur. According to this discharge lamp lighting device, after the period of the DC driving process, the period of the lowest frequency of at least one of the first AC current and the second AC current is shortened. Accordingly, after the electrode projections are fused by performing a DC driving process, an appropriate size of the electrode projection is maintained without flattening the electrode projections at a low frequency. Therefore, an increase in the distance between the electrodes is suppressed, and the flicker phenomenon can be suppressed.

In certain embodiments of the discharge lamp lighting device, the control unit, in accordance with the degraded state of the electrodes of the discharge lamp, may change a longest DC driving process period of at least one DC driving process period of the period during which the first DC driving process is performed and the period during which the second DC driving process is performed in the first and second intervals to be increased.

In a case where the electrodes are degraded, the tip ends of the electrodes cannot be easily fused, and accordingly, the electrode projections may be easily punctured due to discharging. Thus, according to this discharge lamp lighting device, the period of the longest DC driving process of at least one of periods of the DC driving processes in the first and second intervals is lengthened. Accordingly, even in a condition in which the fusibility of the electrodes may easily decrease due to the progress of the degradation, the fusibility of the tip ends of the electrodes is acquired. Thus, since electrode projections having a good shape are maintained, an increase in the distance between the electrodes is suppressed, and the flicker phenomenon can be suppressed.

According to another aspect of the disclosure, there is provided a projector including any of the above-described discharge lamp lighting devices.

According to this projector, electrode projections having a good shape can be formed and maintained while suppressing the blackening of the inside of the luminous tube. Therefore, the light emitting characteristics can be maintained for a long period.

According to still another aspect of the disclosure, there is provided a method of driving a discharge lamp by supplying a driving current to the discharge lamp. The method includes alternately performing a first DC driving process and a first AC driving process in a first interval, and alternately performing a second DC driving process and a second AC driving process in a second interval other than the first interval. A first DC current that is configured by a first polarity component starting from a first polarity is supplied as the driving current in the performing of the first DC driving, a first AC current that repeats the first polarity component and a second polarity component is supplied as the driving current in the performing of the first AC driving, a second DC current that is configured by the second polarity component starting from the second polarity is supplied as the driving current in the performing of the second DC driving, and a second AC current that repeats the first polarity component and the second polarity component is supplied as the driving current in the performing of the second AC driving. A length of at least one of a period of the performing of the first DC driving and a period of the performing of the second DC driving is changed so as to be shortened by time in a stepped manner, and the frequency of the first AC current or the second AC current after the DC driving process is changed.

According to this method, by repeating the stepwise fusion-stretching cycle in the tip ends of the electrodes, electrode projections having a good shape can be formed and maintained while suppressing the blackening of the luminous tube due to excessive fusion of the electrodes.

BRIEF DESCRIPTION OF THE DRAWINGS

Non-limiting and non-exhaustive embodiments of the present disclosure will be described with reference to the accompanying drawings, wherein like numbers reference like elements.

DESCRIPTION OF EXEMPLARY EMBODIMENTS

Hereinafter, embodiments of the disclosure will be described in detail with reference to the accompanying drawings. It is to be understood, however, that other embodiments may be utilized and changes may be made without departing from the scope of the present disclosure. Therefore, the following detailed description is not to be taken in a limiting sense, and the scope of the present disclosure is defined by the appended claims and their equivalents.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," "one," and "the" may include reference to both the singular and the plural. Reference in the specification to "one embodiment" or "an embodiment" means that a particular feature, structure, or characteristic described in connection with the embodiment may be included in at least one embodiment of the disclosure. The appearances of the phrases "in one embodiment" or "in an embodiment" in various places in the specification do not necessarily all refer to the same embodiment, but it may.

Several embodiments will sequentially be described under corresponding section headings below. Section headings are merely employed to improve readability, and they are not to be construed to restrict or narrow the present disclosure. For example, the order of description headings should not necessarily be construed so as to imply that these operations are necessarily order dependent or to imply the relative importance of an embodiment. Moreover, the scope of a disclosure under one section heading should not be construed to restrict or to limit the disclosure to that particular embodiment, rather the disclosure should indicate that a particular feature, structure, or characteristic described in connection with a section heading is included in at least one embodiment of the disclosure, but it may also be used in connection with other embodiments.

1. Optical System of Projector

Figure 1:
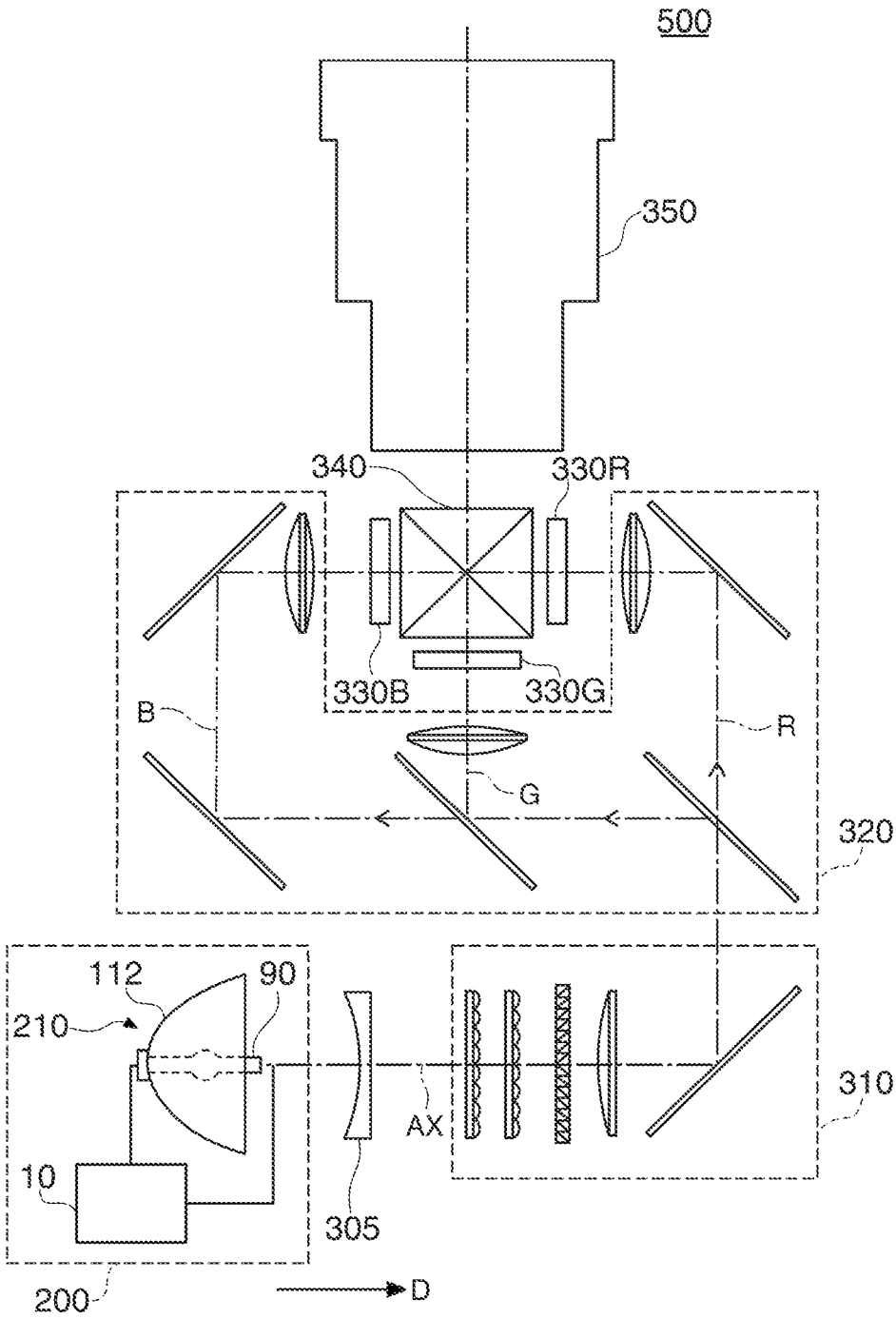
FIG. 1 is an explanatory diagram showing the configuration of a projector according to a first embodiment.

FIG. 1 is an explanatory diagram showing the configuration of a projector 500 according to a first embodiment of the disclosure. The projector 500 includes a light source device 200, a collimating lens 305, an illumination optical system 310, a color separation optical system 320, three liquid crystal light valves 330R, 330G, and 330B, a cross dichroic prism 340, and a projection optical system 350.

The light source device 200 has a light source unit 210 and a discharge lamp lighting device 10. The light source unit 210 has a main reflecting mirror 112, an auxiliary reflecting mirror 50, and a discharge lamp 90. The discharge lamp lighting device 10 supplies electric power to the discharge lamp 90 so that the discharge lamp 90 lights. The main reflecting mirror 112 reflects the light emitted from the discharge lamp 90 toward the irradiation direction D. The irradiation direction D is parallel to the optical axis AX. The light from the light source unit 210 passes through the collimating lens 305 and is then incident on the illumination optical system 310. The collimating lens 305 collimates the light from the light source unit 210.

The illumination optical system 310 equalizes the illuminance of the light from the light source device 200 in the liquid crystal light valves 330R, 330G, and 330B. In addition, the illumination optical system 310 aligns the polarization direction of the light from the light source device 200 in one direction. The reason for this is in order to use the light from the light source device 200 effectively in the liquid crystal light valves 330R, 330G, and 330B. The light whose illuminance distribution and polarization direction have been adjusted is incident on the color separation optical system 320. The color separation optical system 320 separates the incident light into three color light components of red (R), green (G), and blue (B). The three color light components are modulated by the liquid crystal light valves 330R, 330G, and 330B corresponding to the colors, respectively. The liquid crystal light valves 330R, 330G, and 330B include liquid crystal panels 560R, 560G, and 560B and polarizers disposed at the light incidence and emission sides of the liquid crystal panels 560R, 560G, and 560B, respectively. The three modulated color light components are mixed by the cross dichroic prism 340. The mixed light is incident on the projection optical system 350. The projection optical system 350 projects the incident light onto a screen (not shown). As a result, an image is displayed on the screen.

In addition, various known configurations may be adopted as the configurations of the collimating lens 305, the illumination optical system 310, the color separation optical system 320, the cross dichroic prism 340, and the projection optical system 350.

Figure 2:
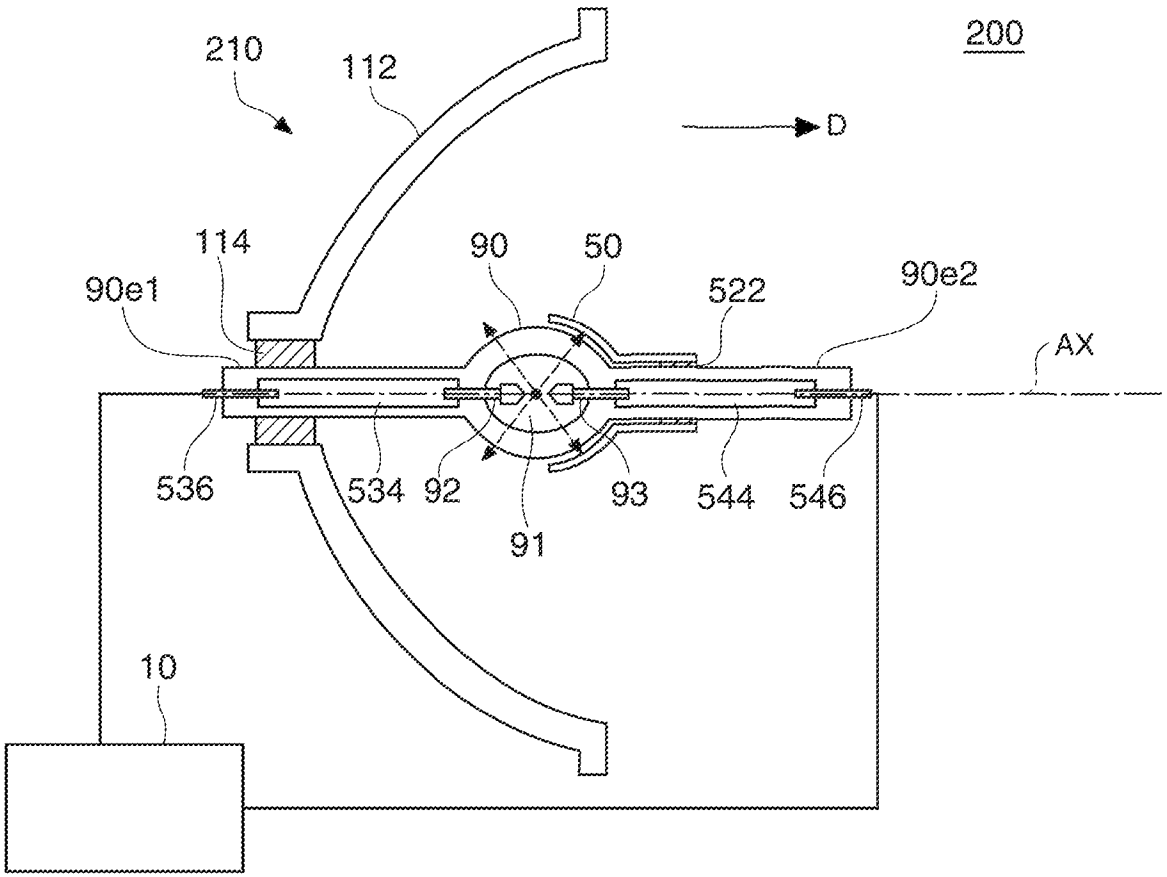
FIG. 2 is an explanatory diagram showing the configuration of a light source device according to the first embodiment.

FIG. 2 is an explanatory diagram showing the configuration of the light source device 200. The light source device 200 has the light source unit 210 and the discharge lamp lighting device 10. In FIG. 2, a sectional view of the light source unit 210 is shown. The light source unit 210 has the main reflecting mirror 112, the discharge lamp 90, and the auxiliary reflecting mirror 50.

The discharge lamp 90 has a rod shape which extends from a first end **90*e*1 to a second end 90*e*2 along the irradiation direction D. A material of the discharge lamp 90 is a translucent material, such as quartz glass. A middle portion of the discharge lamp 90 extends in a spherical shape, and a discharge space 91 is formed therein. Inside the discharge space 91**, gas, which is a discharge medium containing a noble gas, a metal halogen compound, mercury, and the like, is enclosed.

Moreover, in the discharge space 91, two electrodes 92 and 93 protrude from the discharge lamp 90. The first electrode 92 is disposed at the first end **90*e*1 side of the discharge space 91, and the second electrode 93 is disposed at the second end 90*e*2 side of the discharge space 91. Each of the electrodes 92 and 93 has a rod shape extending along the optical axis AX. In the discharge space 91, tip end portions (also called 'discharge ends') of the electrodes 92 and 93 face each other with a predetermined distance therebetween. In addition, the material of each of the electrodes 92 and 93** is metal, such as tungsten.

A first terminal 536 is provided at the first end **90*e*1 of the discharge lamp 90. The first terminal 536 and the first electrode 92 are electrically connected to each other by a conductive member 534 passing through the inside of the discharge lamp 90. Similarly, the second terminal 546 is provided at the second end 90*e*2 of the discharge lamp 90. The second terminal 546 and the second electrode 93 are electrically connected to each other by a conductive member 544 passing through the inside of the discharge lamp 90. The material of each of the terminals 536 and 546 is metal, such as tungsten. Moreover, for example, a molybdenum foil is used for the conductive members 534 and 544**.

The terminals 536 and 546 are connected to the discharge lamp lighting device 10. The discharge lamp lighting device 10 supplies an alternating current to the terminals 536 and 546. As a result, arc discharge occurs between the two electrodes 92 and 93. The light (discharge light) generated by the arc discharge is emitted in all directions from the discharge position, as indicated by dotted arrows.

The main reflecting mirror 112 is fixed to the first end **90*e*1 of the discharge lamp 90 by a fixing member 114. The reflecting surface (surface facing the discharge lamp 90) of the main reflecting mirror 112 has a spheroidal shape. The main reflecting mirror 112 reflects the discharge light toward the irradiation direction D. In addition, the shape of the reflecting surface of the main reflecting mirror 112 is not limited to the spheroid shape, and various shapes allowing the discharge light to be reflected toward the irradiation direction D may also be adopted. For example, the shape of a paraboloid of revolution may be adopted. In this case, the main reflecting mirror 112 can convert the discharge light into light which is almost parallel to the optical axis AX. Accordingly, the collimating lens 305** may not be provided.

The auxiliary reflecting mirror 50 is fixed to the second end **90*e*2 side of the discharge lamp 90 by a fixing member 522. The reflecting surface (surface facing the discharge lamp 90) of the auxiliary reflecting mirror 50 has a spherical shape surrounding the second end 90*e*2 side of the discharge space 91. The auxiliary reflecting mirror 50 reflects the discharge light toward the main reflecting mirror 112. Thus, the use efficiency of the light emitted from the discharge space 91** can be improved.

In addition, as the material of the fixing members 114 and 522, an arbitrary heat-resistant material (for example, an inorganic adhesive) which can withstand the heat generation of the discharge lamp 90 may be adopted. In addition, the method of fixing the arrangement of the main reflecting mirror 112, the auxiliary reflecting mirror 50, and the discharge lamp 90 is not limited to the method of fixing the main reflecting mirror 112 and the auxiliary reflecting mirror 50 to the discharge lamp 90, and an arbitrary method may be adopted. For example, the discharge lamp 90 and the main reflecting mirror 112 may be fixed independently in a housing (not shown) of a projector. The same is true for the auxiliary reflecting mirror 50.

2. Discharge Lamp Lighting Device According to First Embodiment

(1) Configuration of Discharge Lamp Lighting Device

Figure 3:
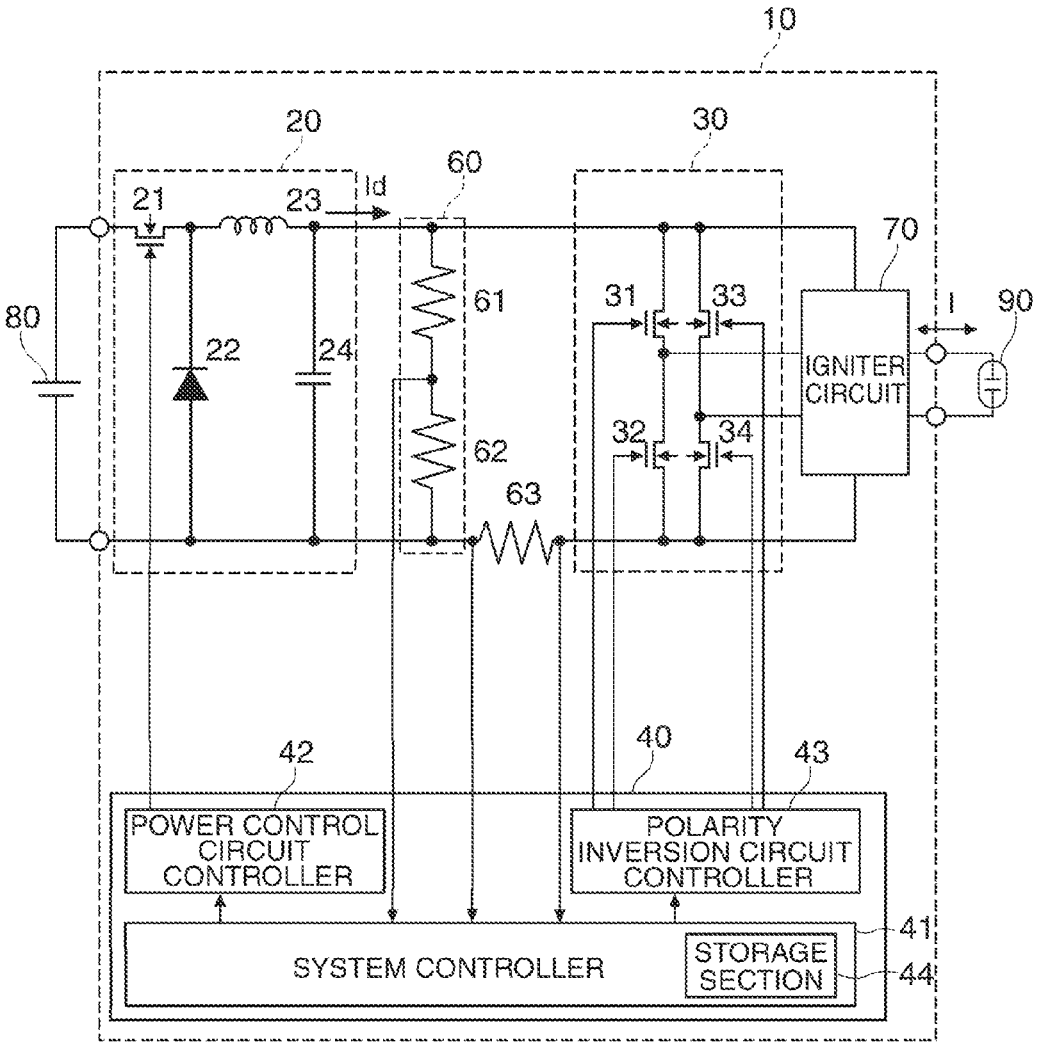
FIG. 3 shows an example of a circuit diagram of a discharge lamp lighting device according to the first embodiment.

FIG. 3 shows an example of the circuit diagram of the discharge lamp lighting device according to this embodiment.

The discharge lamp lighting device 10 includes a power control circuit 20. The power control circuit 20 generates driving electric power supplied to the discharge lamp 90. In the present embodiment, the power control circuit 20 is formed as a down chopper circuit to which power from a DC power supply 80 is input and from which a direct current Id is output after dropping the input voltage.

The power control circuit 20 may be configured to include a switching element 21, a diode 22, a coil 23, and a condenser 24. The switching element 21 may be formed by a transistor, for example. In the present embodiment, one end of the switching element 21 is connected to a positive voltage side of the DC power supply 80, and the other end is connected to a cathode terminal of the diode 22 and one end of the coil 23. In addition, one end of the condenser 24 is connected to the other end of the coil 23, and the other end of the condenser 24 is connected to an anode terminal of the diode 22 and a negative voltage side of the DC power supply 80. A current control signal from a control unit 40 is input to a control terminal of the switching element 21 so that ON/OFF of the switching element 21 is controlled. For example, a PWM (Pulse Width Modulation) control signal may be used as the current control signal.

Here, when the switching element 21 is turned ON, a current flows through the coil 23 so that the energy is stored in the coil 23. Then, when the switching element 21 is turned OFF, the energy stored in the coil 23 is discharged in a path passing through the condenser 24 and the diode 22. As a result, the direct current Id corresponding to the proportion of time for which the switching element 21 is in the ON state is generated.

The discharge lamp lighting device 10 includes a polarity inversion circuit 30. The direct current Id output from the power control circuit 20 is input to the polarity inversion circuit 30. Then, the polarity inversion circuit inverts the polarity of the direct current Id at a predetermined timing to thereby generate and output a driving current I that is a direct current, which continues for a controlled period, or that is an alternating current with an arbitrary frequency. In the present embodiment, the polarity inversion circuit 30 is formed by an inverter bridge circuit (full bridge circuit).

For example, the polarity inversion circuit 30 is configured to include first to fourth switching elements 31 to 34, such as transistors. That is, the polarity inversion circuit 30 is formed by connecting the first and second switching elements 31 and 32, which are connected in series, in parallel to the third and fourth switching elements 33 and 34 connected in series. A polarity inversion control signal from the control unit 40 is input to control terminals of the first to fourth switching elements 31 to 34 so that ON/OFF of the first to fourth switching elements 31 to 34 is controlled.

The polarity inversion circuit 30 alternately inverts the polarity of the direct current Id output from the power control circuit 20 by alternately repeating ON/OFF of the first and fourth switching elements 31 and 34 and the second and third switching elements 32 and 33 and generates and outputs the driving current I that is a direct current, which continues for a controlled period, or that is an alternating current, which has an arbitrary frequency, from a common connection point of the first and second switching elements 31 and 32 and a common connection point of the third and fourth switching elements 33 and 34.

That is, the polarity inversion circuit 30 performs control such that the second and third switching elements 32 and 33 are turned OFF when the first and fourth switching elements 31 and 34 are turned ON and the second and third switching elements 32 and 33 are turned ON when the first and fourth switching elements 31 and 34 are turned OFF. Accordingly, when the first and fourth switching elements 31 and 34 are turned ON, the driving current I which flows from one end of the condenser 24 through the first switching element 31, the discharge lamp 90, and the fourth switching element 34 in this order is generated. In addition, when the second and third switching elements 32 and 33 are turned ON, the driving current I which flows from one end of the condenser 24 through the third switching element 33, the discharge lamp 90, and the second switching element 32 in this order is generated.

In this embodiment, a combination of the power control circuit 20 and the polarity inversion circuit 30 corresponds to a discharge lamp driving section.

The discharge lamp lighting device 10 includes the control unit 40. The control unit 40 controls a holding time of the driving current I for which the same polarity continues and a current value, a frequency, and the like of the driving current I by controlling the power control circuit 20 and the polarity inversion circuit 30. The control unit 40 performs polarity inversion control for the polarity inversion circuit 30 at the polarity inversion timing of the driving current I in order to control a holding time of the driving current I for which the same polarity continues and a frequency and the like of the driving current I. In addition, the control unit 40 performs current control for the power control circuit 20 in order to control the current value of the output direct current Id.

The configuration of the control unit 40 is not particularly limited. In this embodiment, the control unit 40 is configured to include a system controller 41, a power control circuit controller 42, and a polarity inversion circuit controller 43. In addition, a part or the entire control unit 40 may be formed by a semiconductor integrated circuit.

A system controller 41 controls the power control circuit 20 and the polarity inversion circuit 30 by controlling the power control circuit controller 42 and the polarity inversion circuit controller 43. The system controller 41 may control the power control circuit controller 42 and the polarity inversion circuit controller 43 on the basis of the driving current I and a driving voltage Vla detected by a voltage detecting section 60 provided in the discharge lamp lighting device 10, which will be described later.

In this embodiment, the system controller 41 is configured to include a storage section 44. In addition, the storage section 44 may be provided separately from the system controller 41.

The system controller 41 may control the power control circuit 20 and the polarity inversion circuit 30 on the basis of the information stored in the storage section 44. For example, the information regarding driving parameters, such as a holding time of the driving current I for which the same polarity continues, a current value, a frequency, a waveform, and a modulation pattern of the driving current I, may be stored in the storage section 44.

The power control circuit controller 42 controls the power control circuit 20 by outputting a current control signal to the power control circuit 20 on the basis of the control signal from the system controller 41.

The polarity inversion circuit controller 43 controls the polarity inversion circuit 30 by outputting a polarity inversion control signal to the polarity inversion circuit 30 on the basis of the control signal from the system controller 41.

Figure 4:
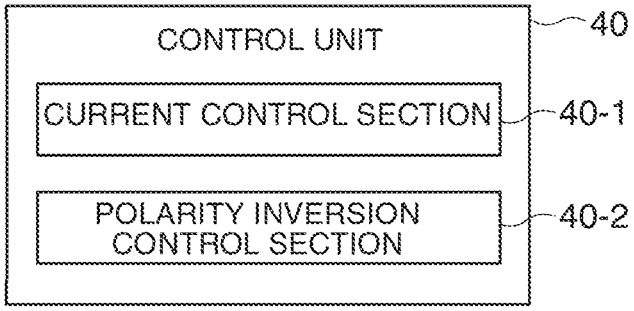
FIG. 4 is a diagram illustrating the configuration of a control unit according to the first embodiment.

In addition, the control unit 40 may be realized by a dedicated circuit so that various kinds of control of the above-described processing or processing to be described later are performed. For example, the control unit 40 may be made to function as a computer by executing a control program stored in the storage section 44 by means of a CPU (Central Processing Unit), such that various kinds of control of the processing are performed. That is, as shown in FIG. 4, the control unit 40 may be made to function as a current control section 40-1, which controls the power control circuit 20, and a polarity inversion control section 40-2, which controls the polarity inversion circuit 30, by a control program.

The discharge lamp lighting device 10 may also include the operation detecting unit. The operation detecting unit may include a voltage detecting section 60, which detects the driving voltage Vla of the discharge lamp 90 and outputs the driving voltage information, or a current detecting section which detects the driving current I and outputs the driving current information, for example. In this embodiment, the voltage detecting section 60 is configured to include first and second resistors 61 to 62.

The voltage detecting section 60 corresponds to a unit that detects the states of the first and second electrodes 92 and 93 of the discharge lamp 90 according to an embodiment of the disclosure. In other words, since the driving voltage Vla is an index of a distance between tip ends of the first and second electrodes 92 and 93, the driving voltage Vla is detected as a value representing the degree of the degraded state of the electrodes.

In this embodiment, the voltage detecting section 60 detects the driving voltage Vla using a voltage divided by the first and second resistors 61 and 62, which are connected in series to each other and which are connected in parallel to the discharge lamp 90. Moreover, in this embodiment, the current detecting section detects the driving current I using a voltage generated in a third resistor 63 connected in series to the discharge lamp 90.

The discharge lamp lighting device 10 may include an igniter circuit 70. The igniter circuit 70 operates only at the start of lighting of the discharge lamp 90 and applies a high voltage (voltage which is higher than the voltage at the time of normal lighting of the discharge lamp 90), which is required to form a discharge path by dielectric breakdown between electrodes of the discharge lamp 90 at the start of lighting of the discharge lamp 90, between the electrodes of the discharge lamp 90. In this embodiment, the igniter circuit 70 is connected in parallel to the discharge lamp 90.

Figure 5A:
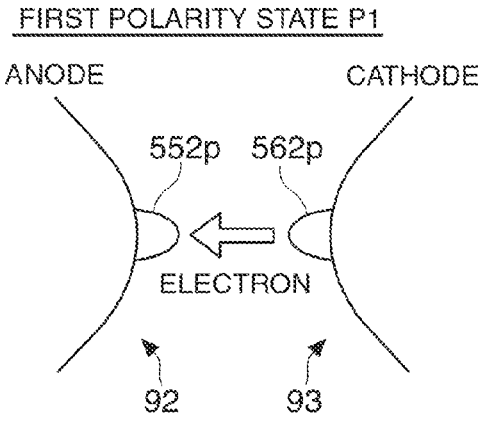
FIGS. 5A to 5D are explanatory diagrams showing the relationship between the polarity of a driving current supplied to a discharge lamp and the temperature of an electrode.
Figure 5B:
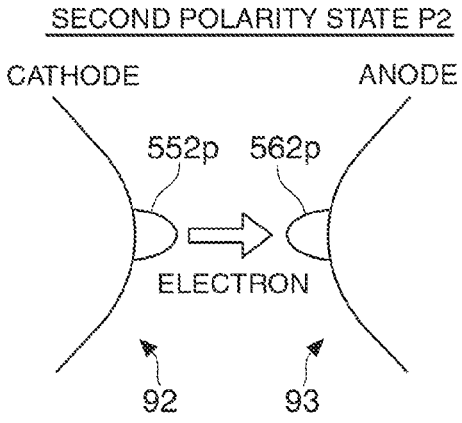

FIGS. 5A to 5D are explanatory diagrams showing the relationship between the polarity of a driving current supplied to the discharge lamp 90 and the temperature of an electrode. FIGS. 5A and 5B show the operation state of the two electrodes 92 and 93. In FIGS. 5A and 5B, tip end portions of the two electrodes 92 and 93 are shown. Projections 552*p* and 562*p* are provided on the tip ends of the electrodes 92 and 93, respectively. Discharge occurs between the projections 552*p* and 562*p*. In this embodiment, the movement of the discharge position (arc position) in each of the electrodes 92 and 93 can be suppressed compared with the case where there is no projection. However, such projections may not be provided.

FIG. 5A shows a first polarity state P1 where the first electrode 92 operates as an anode and the second electrode 93 operates as a cathode. In the first polarity state P1, an electron moves from the second electrode 93 (cathode) to the first electrode 92 (anode) by discharge. An electron is emitted from the cathode (second electrode 93). The electron emitted from the cathode (second electrode 93) collides with the tip end of the anode (first electrode 92). Heat is generated by the collision, and the temperature of the tip end (projection 552*p*) of the anode (first electrode 92) rises.

FIG. 5B shows a second polarity state P2 where the first electrode 92 operates as a cathode and the second electrode 93 operates as an anode. In the second polarity state P2, an electron moves from the first electrode 92 to the second electrode 93 contrary to the first polarity state P1. As a result, the temperature of the tip end (projection 562*p*) of the second electrode 93 rises.

As above, the temperature of the electrode at the time of serving as an anode tends to rise higher than that of the electrode at the time of serving as a cathode. Here, keeping a state where the temperature of one electrode is higher than that of the other electrode may cause various problems. For example, when the tip end of a high-temperature electrode melts excessively, unintended electrode deformation may occur. As a result, the arc length may deviate from the appropriate value. In addition, when the tip end of a low-temperature electrode melts insufficiently, fine uneven parts generated on the tip end may remain without melting away. Similarly, when the tip end of the low-temperature electrode melts insufficiently, the projection is exposed to unintended temperature so as to be flattened. As a result, so-called arc jump or flicker may occur.

Figure 5C:
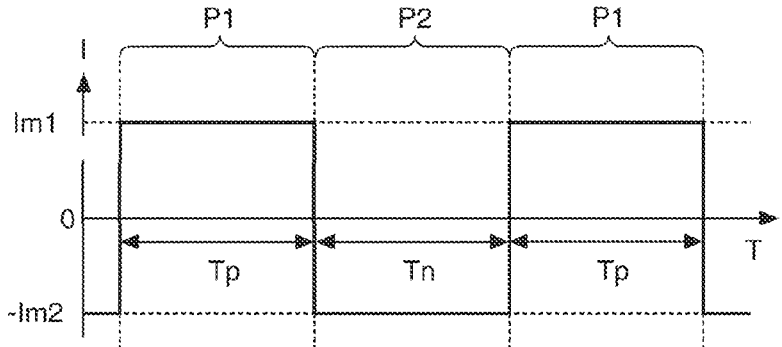

As a technique of suppressing such a problem, AC driving for changing the polarity of each electrode repeatedly may be used. FIG. 5C is a timing chart showing an example of the driving current I supplied to the discharge lamp 90 (FIG. 2). The horizontal axis indicates a time T, and the vertical axis indicates the current value of the driving current I. The driving current I indicates a current flowing through the discharge lamp 90. The positive value indicates the first polarity state P1, and the negative value indicates the second polarity state P2. In the example shown in FIG. 5C, a rectangular wave alternating current is used. In addition, the first and second polarity states P1 and P2 are repeated alternately. Here, a first polarity interval Tp indicates a time for which the first polarity state P1 continues, and a second polarity interval Tn indicates a time for which the second polarity state P2 continues. In addition, the average current value of the first polarity interval Tp is 1 ml, and the average current value of the second polarity interval Tn is −Im2. In addition, a frequency of the driving current I suitable for the driving of the discharge lamp 90 may be experimentally determined according to the characteristic of the discharge lamp 90 (for example, a single value or a plurality of values in a range of 30 Hz to 1 kHz is adopted). Similarly, the other values 1 ml, −Im2, Tp, and Tn may also be determined experimentally.

Figure 5D:
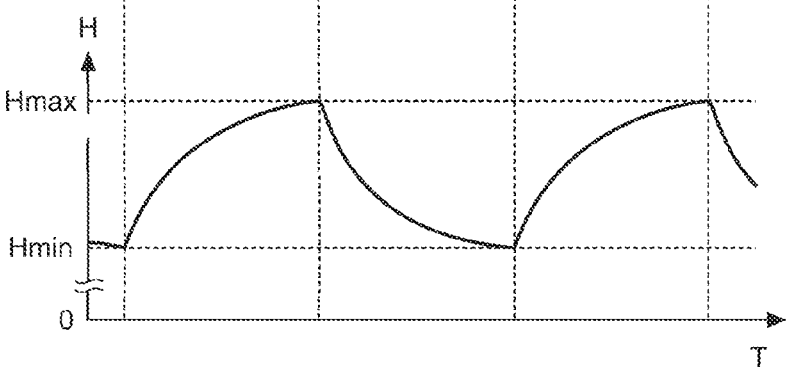

FIG. 5D is a timing chart showing a change in the temperature of the first electrode 92. The horizontal axis indicates a time T, and the vertical axis indicates a temperature H. The temperature H of the first electrode 92 rises in the first polarity state P1 and drops in the second polarity state P2. In addition, since the first and second polarity states P1 and P2 are repeated, the temperature H changes periodically between the minimum value Hmin and the maximum value Hmax. In addition, although not shown, the temperature of the second electrode 93 changes in an opposite phase to the temperature H of the first electrode 92. That is, the temperature of the second electrode 93 drops in the first polarity state P1 and rises in the second polarity state P2.

Since the tip end of the first electrode 92 (projection 552*p*) melts in the first polarity state P1, the tip end of the first electrode 92 (projection 552*p*) becomes smooth. As a result, the movement of the discharge position in the first electrode 92 can be suppressed. In addition, since the temperature of the tip end of the second electrode 93 (projection 562*p*) drops, the excessive melting of the second electrode 93 (projection 562*p*) is suppressed. As a result, unintended electrode deformation can be suppressed. In the second polarity state P2, the states of the first and second electrodes 92 and 93 are opposite. Accordingly, a problem in each of the two electrodes 92 and 93 can be suppressed by repeating the two states P1 and P2.

In addition, when an alternating current having a relatively low frequency is supplied, the electrode at the time of serving as an anode is heated too much over a wide range (an arc spot (a hot spot on the electrode surface) formed in accordance with arc discharge becomes large). Accordingly, the shape of the electrode collapses due to excessive fusion, and the scattering of the electrode material increases. On the contrary, if the electrode is too cold (the arc spot becomes small), the tip end of the electrode cannot melt sufficiently. As a result, the tip end cannot be returned smoothly. In addition, in a case where a low frequency is supplied, when the electrode serves as a cathode, a period during which the electrode is exposed to unintended particle collision becomes long. In other words, the tip end of the electrode easily deforms due to such factors. On the other hand, in a case where alternating current driving is performed with a high frequency, the arc spot becomes small. Accordingly, only small projections are formed, and the electrode projection that becomes an arc calescence point is unclear. Thus, a plurality of electrode projections is formed, and arc jump can be generated between the plurality of projections. Therefore, when a uniform alternating-current driving process for the electrode is continued, the tip ends (projections 552*p* and 562*p*) of the electrode deform to an unintended shape, or a flicker phenomenon may easily occur.

(2) Example of Control of Discharge Lamp Lighting Device

Next, a specific example of control of the discharge lamp lighting device 10 according to the first embodiment will be described.

The control unit 40 of the discharge lamp lighting device 10 according to the first embodiment performs control of supplying a first DC current that is configured by a first polarity component starting from the first polarity as the driving current I in a DC driving process of a first interval and performs control of supplying a first AC current in which the first polarity component and a second polarity component are repeated at a first frequency as the driving current I in an AC driving process of the first interval.

The control unit 40 performs control of supplying a second DC current that is configured by a second polarity component starting from a second polarity as the driving current I in the DC driving process of the second interval and control of supplying a second AC current in which the first polarity component and the second polarity component are repeated at the second frequency as the driving current I in the AC driving process of the second interval.

The control unit 40 alternately performs a DC driving process of the first interval and an AC driving process of the first interval during the first interval. In the first interval, at least one sub-interval 1 is included. The sub-interval 1 is configured by first-interval first to first-interval third DC driving processes D1-1, D1-2, and D1-3 that are three different types of DC driving processes of the first interval and first-interval first to first-interval third AC driving processes A1-1, A1-2, and A1-3 that are three different types of AC driving processes of the first interval of which the frequencies, the numbers of cycles, or both the frequencies and the numbers of cycles are different from each other.

Thereafter, the control unit 40 alternately performs a DC driving process of a second interval and an AC driving process of the second interval during the second interval different from the first interval. In the second interval, at least one sub-interval 2 is included. The sub-interval 2 is configured by second-interval first to second-interval third DC driving processes D2-1, D2-2, and D2-3 that are three different types of DC driving processes of the second interval and second-interval first to second-interval third AC driving processes A2-1, A2-2, and A2-3 that are three different types of AC driving processes of the second interval of which the frequencies, the numbers of cycles, or both the frequencies and the numbers of cycles are different from each other.

Figure 6A:
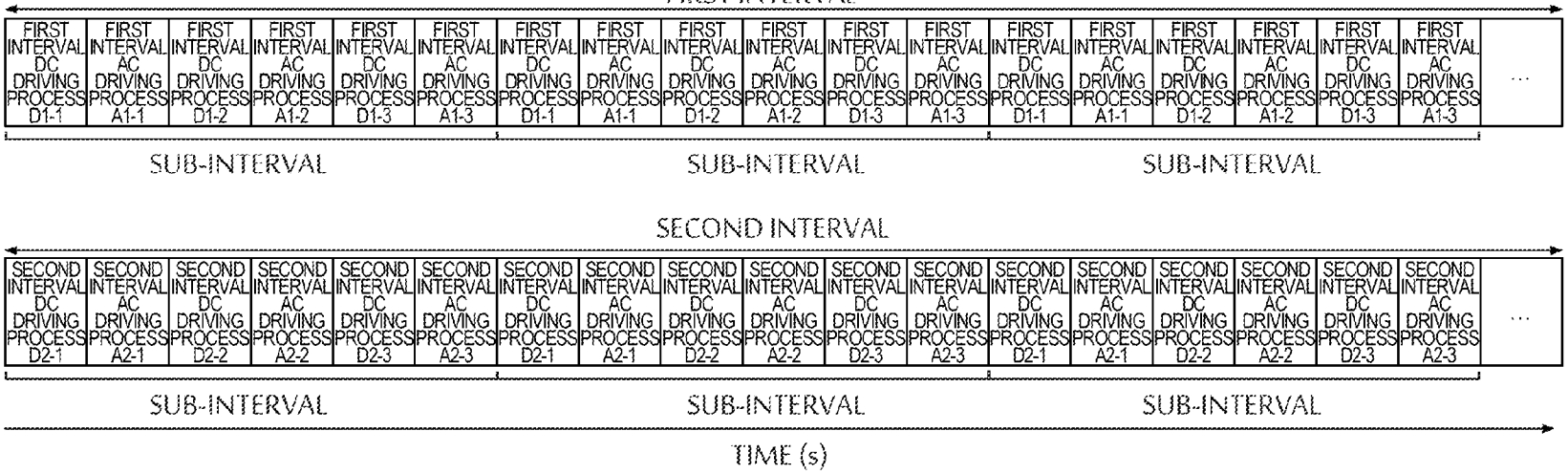
FIGS. 6A and 6B are diagrams illustrating first and second intervals according to the first embodiment.
Figure 6B:
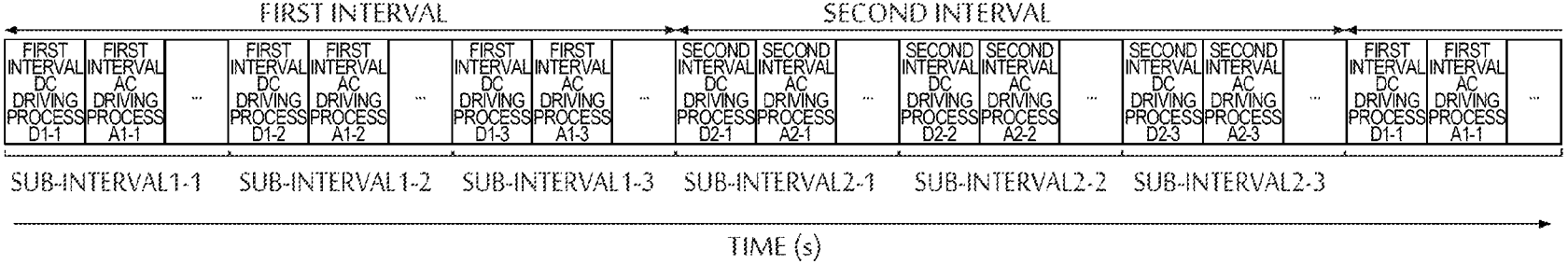

FIGS. 6A and 6B are diagrams illustrating the first interval and the second interval.

In the example illustrated in FIG. 6A, the control unit 40 performs control by switching among a plurality of sub-intervals 1 during the first interval. The control unit 40, in each sub-interval 1, after the first-interval first DC driving process D1-1 in which DC driving of supplying the first DC current to the discharge lamp 90 is performed, performs AC driving through the first-interval first AC driving process A1-1 in which the first AC current is supplied to the discharge lamp 90, then performs DC driving through the first-interval second DC driving process D1-2 in which the period during which the first DC current is supplied to the discharge lamp 90 is different from that of the first-interval first DC driving process D1-1, then performs AC driving through the first-interval second AC driving process A1-2 in which the first AC current having a frequency different from that of the first AC current used in the first-interval first AC driving process A1-1 is supplied to the discharge lamp 90, then performs DC driving through the first-interval third DC driving process D1-3 in which the period during which the first DC current is supplied is different from those of the first-interval first and first-interval second DC driving processes D1-1 and D1-2, and then performs AC driving through the first-interval third AC driving process A1-3 in which the first AC current having a frequency different from the frequency of the first AC current used in the first-interval first and first-interval second AC driving processes A1-1 and A1-2 is supplied to the discharge lamp 90. The control unit 40 performs the process of the first interval in which at least one sub-interval 1 is included.

Thereafter, after the first interval, the control unit 40 performs control by switching among a plurality of sub-intervals 2 during the second interval. The control unit 40, in each sub-interval 2, after the second-interval first DC driving process D2-1 in which DC driving of supplying the second DC current to the discharge lamp 90 is performed, performs AC driving through the second-interval first AC driving process A2-1 in which the second AC current is supplied to the discharge lamp 90, then performs DC driving through the second-interval second DC driving process D2-2 in which the period during which the second DC current is supplied to the discharge lamp 90 is different from that of the second-interval first DC driving process D2-1, then performs AC driving through the second-interval second AC driving process A2-2 in which the second AC current having a frequency different from that of the second AC current used in the second-interval first AC driving process A2-1 is supplied to the discharge lamp 90, then performs DC driving through the second-interval third DC driving process D2-3 in which the period during which the second DC current is supplied to the discharge lamp 90 is different from those of the second-interval first and second-interval second DC driving processes D2-1 and D2-2, and then performs AC driving through the second-interval third AC driving process A2-3 in which the second AC current having a frequency different from the frequency of the second AC current used in the second-interval first and second-interval second AC driving processes A2-1 and A2-2 is supplied to the discharge lamp 90. The control unit 40 performs the process of the second interval in which at least one sub-interval 2 is included. The control unit 40 controls the discharge lamp driving section such that the first interval and the second interval alternately appear.

As above, the control unit 40 can alternately perform the DC driving process of the first interval and the AC driving process of the first interval during the first interval, and can alternately perform the DC driving process of the second interval and the AC driving process of the second interval during the second interval. In addition, the control unit 40, during the sub-interval 1 at least one of which is included in the first interval, can perform the DC driving processes of the first interval for which the driving conditions are different from each other and the AC driving processes of the first interval for which the driving conditions are different from each other in a predetermined order, and, during the sub-interval 2 at least one of which is included in the second interval, can perform the DC driving processes of the second interval for which the driving conditions are different from each other and the AC driving processes of the second interval for which the driving conditions are different from each other in a predetermined order.

In addition, in this embodiment, the control unit 40 controls the discharge lamp driving section by repeating the sub-intervals 1 ten times as the first interval, controls the discharge lamp driving section by repeating the sub-intervals 2 ten times as the second interval, and then controls the discharge lamp driving section such that the first interval and the second interval are repeated similarly.

Furthermore, the control unit 40, as illustrated in FIG. 6B, may control the first sub-interval 1 at least one of which is included in the first interval to include the sub-interval 1-1, the sub-interval 1-2, and the sub-interval 1-3 and control the sub-interval 2 at least one of which is included in the second interval to include the sub-interval 2-1, the sub-interval 2-2, and the sub-interval 2-3.

The control unit 40 may control the discharge lamp driving section such that, in the sub-interval 1 of the first interval, the first-interval first DC driving process D1-1 and the first-interval first AC driving process A1-1 are repeatedly performed a plurality of times (for example, ten times or the like) in the sub-interval 1-1, then the first-interval second DC driving process D1-2 and the first-interval second AC driving process A1-2 are repeatedly performed a plurality of times in the sub-interval 1-2, and thereafter the first-interval third DC driving process D1-3 and the first-interval third AC driving process A1-3 are repeatedly performed a plurality of times in the sub-interval 1-3. In addition, in the following sub-interval 2 of the second interval, the control unit 40 may control the discharge lamp driving section such that the second-interval first DC driving process D2-1 and the second-interval first AC driving process A2-1 are repeatedly performed a plurality of times in the sub-interval 2-1, then the second-interval second DC driving process D2-2 and the second-interval second AC driving process A2-2 are repeatedly performed a plurality of times in the sub-interval 2-2, and thereafter the second-interval third DC driving process D2-3 and the second-interval third AC driving process A2-3 are repeatedly performed a plurality of times in the sub-interval 2-3.

Also in this case, the control unit 40 can alternately perform the DC driving process of the first interval and the AC driving process of the first interval in the first interval and alternately perform the DC driving process of the second interval and the AC driving process of the second interval in the second interval. In addition, the control unit 40 can sequentially perform the DC driving processes of the first interval for which the driving conditions are different from each other and the AC driving processes of the first interval for which the driving conditions are different from each other in the sub-interval 1 at least one of which is included in the first interval and sequentially perform the DC driving processes of the second interval for which driving conditions are different from each other and the AC driving processes of the second period for which the driving conditions are different from each other in the sub-interval 2 at least one of which is included in the second interval.

In addition, the control unit 40 may control the discharge lamp driving section such that a third interval other than the first interval and the second interval appears. For example, the control unit 40 may control the discharge lamp driving section such that a third interval, during which only AC driving processes of the third interval are performed, appears between the first interval and the second interval.

In such a case, the control unit 40 may perform control of supplying as the driving current I a third AC current in which the first polarity component and the second polarity component are repeated at a third frequency different from the first frequency of the first AC current of the AC driving process of the first interval and the second frequency of the second AC current of the AC driving process of the third interval, in the AC driving process of the third interval.

Next, the influence on the first electrode 92 and the second electrode 93 will be described in a case where the discharge lamp 90 is DC driven and a case where the discharge lamp 90 is AC driven.

During the DC-driven period in which the driving current I is a direct current, a current flows with the same polarity. For example, in a case where the DC driving process of the first interval is performed, the first electrode 92 is at high temperature, and accordingly, the tip end portion of the electrode including unnecessary projections can melt to be smooth.

During the AC-driven period in which the driving current I is an alternating current, a current of which the polarity alternately repeats to be the first polarity or the second polarity flows. Accordingly, the projection fusion at the time of serving as an anode and cooling and particle collision at the time of serving as a cathode occur, and therefore, the growth of the projections in the tip end portion that is necessary as a discharge starting point can be promoted.

Here, according to this embodiment, during the sub-interval 1 of the first interval, the DC driving processes of the first interval for which the driving conditions are different from each other and the AC driving processes of the first interval for which the driving conditions are different from each other are performed in a predetermined order such that the DC driving and the AC driving are alternately performed, and during the sub-interval 2 of the second interval, the DC driving processes of the second interval for which the driving conditions are different from each other and the AC driving processes of the second interval for which the driving conditions are different from each other are performed in a predetermined order such that the DC driving and the AC driving are alternately performed.

The DC driving, which is performed during one sub-interval 1 of the first interval, is performed in the order of the first-interval first DC driving process D1-1, the first-interval second DC driving process D1-2, and the first-interval third DC driving process D1-3, and the control unit 40 controls the discharge lamp driving section such that the period during which the first DC current is supplied to the discharge lamp 90 decreases in that order.

The DC driving, which is performed during one sub-interval 2 of the second interval, is performed in the order of the second-interval first DC driving process D2-1, the second-interval second DC driving process D2-2, and the second-interval third DC driving process D2-3, and the control unit 40 controls the discharge lamp driving section such that the period during which the second DC current is supplied to the discharge lamp 90 decreases in that order.

The AC driving, which is performed during one sub-interval 1 of the first interval, is performed in the order of the first-interval first AC driving process A1-1, the first-interval second AC driving process A1-2, and the first-interval third AC driving process A1-3, and the control unit 40 controls the discharge lamp driving section such that the frequency of the first AC current supplied to the discharge lamp 90 increases in that order.

The AC driving, which is performed during one sub-interval 2 of the second interval, is performed in the order of the second-interval first AC driving process A2-1, the second-interval second AC driving process A2-2, and the second-interval third AC driving process A2-3, and the control unit 40 controls the discharge lamp driving section such that the frequency of the second AC current supplied to the discharge lamp 90 increases in that order.

In addition, the control unit 40 may control the discharge lamp driving section such that the change in the length of the DC driving period is performed in at least one of the DC driving process of the first interval and the DC driving process of the second interval. Furthermore, a case where the driving conditions for the AC driving are changed is desirable in that the shape of the tip end of the electrode can be well maintained. However, in a case where the length of the period of the DC driving is changed, the control unit 40 may control the discharge lamp driving section such that all the driving conditions for the AC driving are the same.

As above, according to this embodiment, at least one of the length of the period during which the DC driving process of the first interval is performed and the length of the period during which the DC driving process of the second interval is performed is changed to be shorter in the order of performance during one sub-interval 1 or one sub-interval 2 in a stepped manner. Accordingly, for example, in the case of the first electrode 92, the degree of fusion in the electrode tip end of the discharge lamp is limited in a stepped manner in accordance with the first-interval first to first-interval third DC driving processes D1-1, D1-2, and D1-3.

In addition, according to this embodiment, through an operation in which the DC driving and the AC driving are alternately performed, a base of large projections is formed in the tip end of the electrode by performing AC-current driving after a DC driving process in which a DC driving period is long, the area to be fused decreases as the length of DC driving in a DC driving process performed thereafter decreases from the period of the DC driving in the DC driving process previously performed, projections are grown in an area portion fused by an AC current supplied in an AC driving process performed thereafter, the fused area is finally further limited by DC driving having the shortest period in a DC driving process performed thereafter, and the tip end of the electrode projection that becomes astable arc calescence point is grown by an AC current supplied in an AC driving process performed thereafter.

In the above-described embodiment, the periods of the first-interval first to first-interval third DC driving processes D1-1, D1-2, and D1-3 are shortened in the order of performance in the sub-interval 1, and the periods of the second-interval first to second-interval third DC driving processes D2-1, D2-2, and D2-3 are further shortened in the order of performance in the sub-interval 2. However, either the periods of the first-interval first to first-interval third DC driving processes D1-1, D1-2, and D1-3, or the periods of the second-interval first to second-interval third DC driving processes D2-1, D2-2, and D2-3 may be set as the same period, or the periods may be changed in a pattern other than the pattern in which the periods are further shortened in the order of performance. However, in order to acquire the symmetry between both electrodes, it is preferable that there is symmetry between the driving conditions for the first interval and the second interval.

TABLE 1A

| | Time (ms) | Frequency (Hz), Number of cycles | Time (ms) | Frequency (Hz), Number of cycles | Time (ms) | Frequency (Hz), Number of cycles |
|---|---|---|---|---|---|---|
| First | D1-1 | A1-1 | D1-2 | A1-2 | D1-3 | A1-3 |
| Interval | 7.7 | 95, 5 | 4.8 | 165, 5 | 3.7 | 220, 5 |
| Second | D2-1 | A2-1 | D2-2 | A2-2 | D2-3 | A2-3 |
| Interval | 7.7 | 95, 5 | 4.8 | 165, 5 | 3.7 | 220, 5 |

TABLE 1B

| | Time (ms) | Frequency (Hz), Number of cycles | Time (ms) | Frequency (Hz), Number of cycles | Time (ms) | Frequency (Hz), Number of cycles |
|---|---|---|---|---|---|---|
| First | D1-1 | A1-1 | D1-2 | A1-2 | D1-3 | A1-3 |
| Interval | 7.7 | 95, 5 | 5.2 | 165, 5 | 3.7 | 220, 5 |
| Second | D2-1 | A2-1 | D2-2 | A2-2 | D2-3 | A2-3 |
| Interval | 10.7 | 95, 5 | 3.2 | 165, 5 | 2.95 | 220, 5 |

Table 1A shows an exemplary table of driving conditions, which are stored in the storage section 44, for the DC driving process of the first interval, the AC driving process of the first interval, the DC driving process of the second interval, and the AC driving process of the second interval according to this embodiment. Specific numeric values of the DC driving periods of the first-interval first to first-interval third DC driving processes D1-1, D1-2, and D1-3 as the DC driving process of the first interval, the DC driving periods of the second-interval first to second-interval third DC driving processes D2-1, D2-2, and D2-3 as the DC driving process of the second interval, the numbers of cycles and the frequencies of the first AC currents in the AC driving performed in the first-interval first to first-interval third AC driving processes A1-1, A1-2 and A1-3 in the AC driving process of the first interval, and the numbers of cycles and the frequencies of the second AC currents in the AC driving performed in the second-interval first to second-interval third AC driving processes A2-1, A2-2 and A2-3 in the AC driving process of the second interval are shown in Table 1A. Here, the AC driving process of the first interval supplies an AC current that starts with the first polarity and ends with the second polarity, and the AC driving process of the second interval supplies an AC current that starts with the second polarity and ends with the first polarity.

In addition, in Table 1A, the period of the DC driving performed in each of the first-interval first to first-interval third DC driving processes D1-1, D1-2, and D1-3 in the DC driving process of the first interval and the period of the DC driving performed in each of the second-interval first to second-interval third DC driving processes D2-1, D2-2, and D2-3 in the DC driving process of the second interval are set to be the same, and the number of cycles and the frequency of the AC driving performed in each of the first-interval first to first-interval third AC driving processes A1-1, A1-2, and A1-3 in the AC driving process of the first interval and the number of cycles and the frequency of the AC driving performed in each of the second-interval first to second-interval third AC driving processes A2-1, A2-2, and A2-3 in the AC driving process of the second interval are set to the same. An AC current that starts with the first polarity and ends with the second polarity may be supplied in both the AC driving process of the first interval and the AC driving process of the second interval. In addition, by using a table of the driving conditions as shown in FIG. 1B, heat loads of the electrodes may be equalized according to the need.

Table 1B shows a table of driving conditions in which the AC driving process of the first interval and the AC driving process of the second interval are the same as those of Table 1A but the DC driving process of the first interval and the DC driving process of the second interval are different from those of Table 1A. In the table of the driving conditions shown in Table 1B, an example is shown in which a heat load applied to an electrode due to a combination of the polarity of AC driving performed thereafter is adjusted by changing the lengths of the periods of the DC driving in the second-interval first to second-interval third DC driving processes D2-1, D2-2, and D2-3.

Figure 7A:
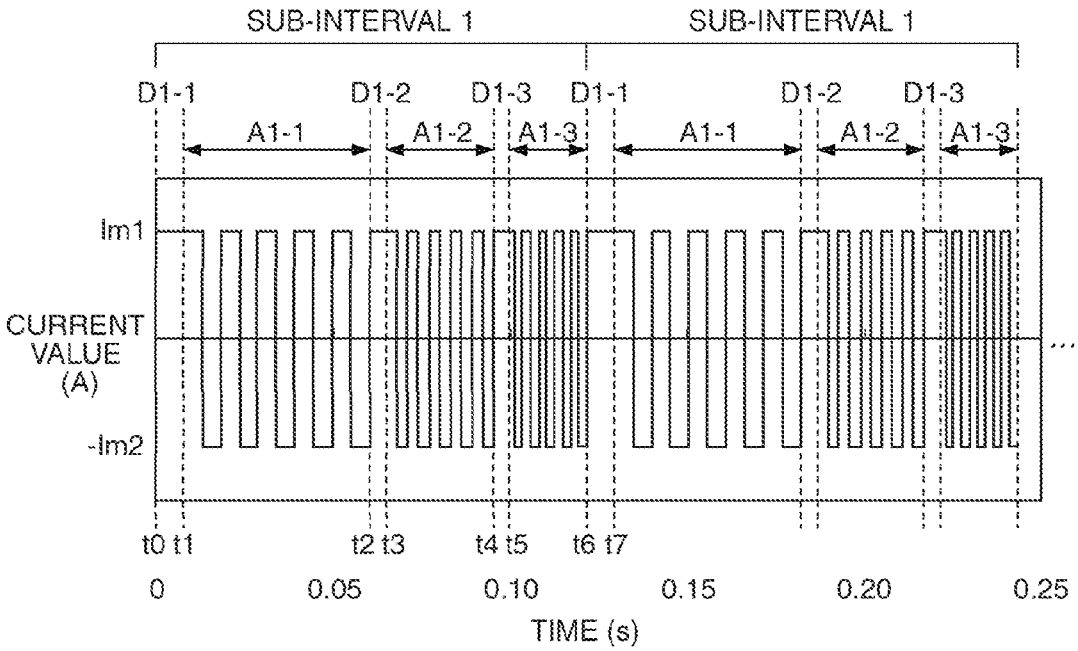
FIG. 7A is an example of the waveform of a driving current in the first interval according to the first embodiment.
Figure 7B:
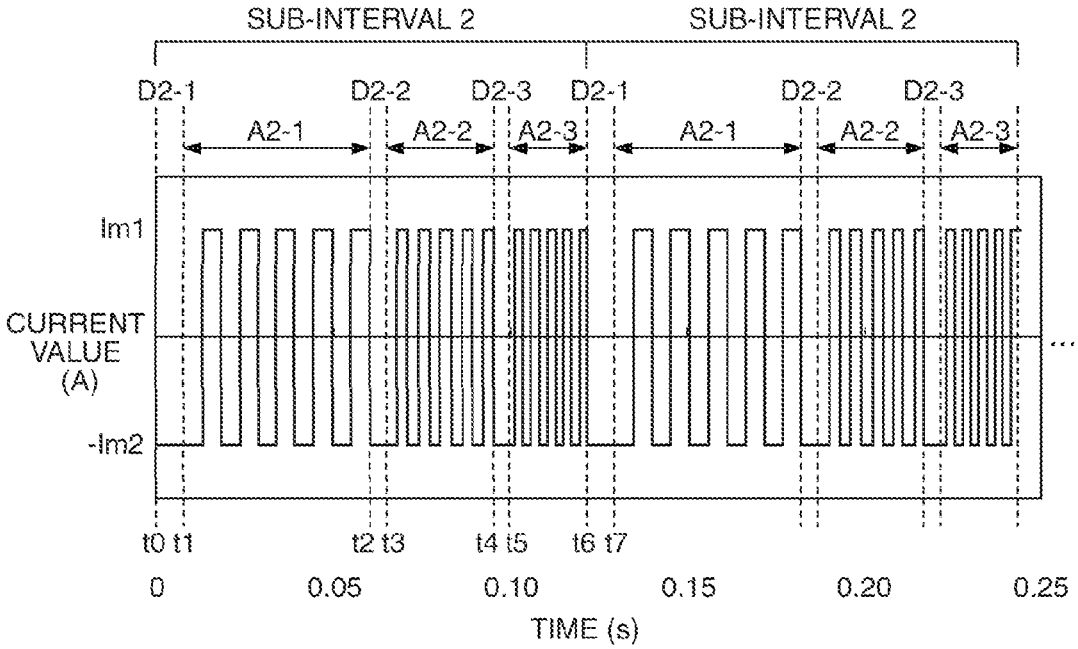
FIG. 7B is a timing diagram showing an example of the waveform of a driving current in the second interval according to the first embodiment.

FIG. 7A shows an example of the waveform of the driving current I in the first interval shown in Table 1A, and FIG. 7B is a timing diagram showing an example of the waveform of the driving current I in the second interval shown in Table 1A. In FIGS. 7A and 7B, the driving current I having the first polarity is set to a positive value, and the driving current I having the second polarity is set to a negative value.

The example shown in FIG. 7A shows two sub-intervals 1 in which the control unit 40 performs a first-interval first DC driving process D1-1 during a period from time t0 to time t1, a first-interval first AC driving process A1-1 during a period from time t1 to time t2, a first-interval second DC driving process D1-2 during a period from time t2 to time t3, a first-interval second AC driving process A1-2 during a period from time t3 to time t4, a first-interval third DC driving process D1-3 during a period from time t4 to time t5, and a first-interval third AC driving process A1-3 during a period from time t5 to time t6.

The example shown in FIG. 7B shows two sub-intervals 2 in which the control unit 40 performs a second-interval first DC driving process D2-1 during a period from time t0 to time t1, a second-interval first AC driving process A2-1 during a period from time t1 to time t2, a second-interval second DC driving process D2-2 during a period from time t2 to time t3, a second-interval second AC driving process A2-2 during a period from time t3 to time t4, a second-interval third DC driving process D2-3 during a period from time t4 to time t5, and a second-interval third AC driving process A2-3 during a period from time t5 to time t6.

In addition, in the example shown in FIG. 7B, the control unit 40 performs control of supplying the driving current I that is a rectangular-wave alternating current starting from a phase having the same polarity (the second polarity) as those of the second-interval first to second-interval third DC driving processes D2-1, D2-2, and D2-3, in the second-interval first to second-interval third AC driving processes A2-1, A2-2, and A2-3.

As described above, according to this embodiment, as the period during which the DC driving process of the first interval is performed and the period during which the DC driving process of the second interval is performed are shortened in a stepped manner within one sub-interval 1 or one sub-interval 2, the frequency of the first AC current or the second AC current in the AC driving process of the first interval that is alternately performed with the DC driving process of the first interval and the AC driving process of the second interval performed alternately with the DC driving process of the second interval is changed by time so as to relatively increase in the order or performance within one sub-interval 1 or one sub-interval 2. Through this operation, by performing an AC driving process in which AC driving is performed with an AC current having a relatively low frequency within the sub-interval immediately after a DC driving process in which the DC driving period is the longest within the sub-interval, in a case where electrode projections are fused in the DC driving process, large projections can be formed by slowly inverting the polarity during the AC driving process.

When a fused area of the tip end portion of the electrode decreases by decreasing the length of the DC driving period in the DC driving process performed next from the DC driving period in the DC driving process previously performed, projections formed in that portion can be grown by the AC current supplied in the AC driving process performed next. Finally, by performing an AC driving process in which AC driving having the highest frequency within the sub-interval after a DC driving process having the shortest DC driving period within the sub-interval is performed, the polarity of the limited fused area of the projection of the electrode is inverted in a relatively speedy manner, whereby the effect of growing the tip end can be acquired more effectively. In addition, by not performing a low-frequency AC driving process for the area having low fusibility, the scattering of electrode components can be suppressed.

In other words, in the case of the control method shown in FIG. 7A, for the first electrode 92, after the first-interval first DC driving process D1-1 in which the DC driving period is relatively long among the DC driving processes of the first interval that are performed within one sub-interval 1 is performed, the first-interval first AC driving process A1-1 in which the first AC current having a relatively low frequency among the AC driving processes of the first interval that are performed within one sub-interval 1 is supplied is performed, whereby a base of a large projection is effectively formed. In addition, by performing the first-interval third AC driving process A1-3 in which an AC current having a relatively high frequency among the AC driving processes of the first interval that are performed within one sub-interval 1 is supplied after the first-interval third DC driving process D1-3 in which the DC driving period is relatively short among the DC driving processes performed within one sub-interval 1, there is an effect that the fused portion of the limited projection of the electrode tip end portion is stretched.

Accordingly, by repeating a stepwise fusion-stretch cycle of the tip end of the electrode by performing such a driving process, electrode projections having a good shape can be formed and maintained while suppressing the blackening of the luminous tube due to excessive fusion of the electrode. Therefore, the discharge lamp 90 can be stably lit.

In addition, according to this embodiment, although three types of DC driving process and three types of AC driving process are performed during the first interval and the second interval, the number of the types may be appropriately set in accordance with the state of the electrode and the like.

Furthermore, in this embodiment, within the sub-interval 1 or the sub-interval 2, a DC driving process in which a DC current is supplied to the discharge lamp 90 for a longest period is set as the DC driving process that is performed first in the sub-interval, and a DC driving process in which a DC current is supplied to the discharge lamp 90 for a shortest period is set as the DC driving process performed last in the sub-interval. However, in a case where a plurality of types of DC driving process is used, the DC driving process in which DC current is supplied to the discharge lamp 90 for the longest period does not need to be performed first in the sub-interval. Thus, control may be performed such that a DC driving process in which a DC current is supplied to the discharge lamp 90 for a relatively long period among the plurality of types of DC driving process is performed in the first half of the sub-interval, and a DC driving process in which a DC current is supplied to the discharge lamp 90 for a relatively short period among the plurality of types of DC driving process is performed in the second half of the sub-interval.

In addition, the frequency of the AC current in the AC driving processing period may not be a single frequency in each period, and, for example, the frequency may be changed in the middle of the first-interval first AC driving process A1-1. In such a case, the control unit 40 may perform control such that the average frequency of the first-interval first AC driving process A1-1, the average frequency of the first-interval second AC driving process A1-2, and the average frequency of the first-interval third AC driving process A1-3 increase in this order in a stepped manner. In addition, the same control may be performed during the second interval.

3. Discharge Lamp Lighting Device According to Second Embodiment

Next, a specific example of control of a discharge lamp lighting device 10 according to a second embodiment will be described.

In the discharge lamp lighting device 10 according to the first embodiment, the control unit 40 performs control such that predetermined driving processes of the first interval and the second interval are repeated. However, according to the discharge lamp lighting device 10 of the second embodiment, the control unit 40, in accordance with the progress of the degraded state of the first electrode 92 and the second electrode 93 of the discharge lamp 90, here, an increase in the driving voltage Vla, performs control such that the number of cycles of the AC current in an AC driving process, which has a relatively low frequency, of at least one of a period during which the AC driving process of the first interval is performed and a period during which the AC driving process of the second interval is performed is decreased so as to shorten the length of the period during which the process is performed, and the number of cycles of the AC current in an AC driving process, which has a relatively high frequency, is increased so as to lengthen the period during which the process is performed. The other operations are the same as those of the first embodiment, and thus the detailed description thereof will be omitted.

Although the lifespan of the discharge lamp 90 is enhanced by the units shown in the first embodiment, it is inevitable for the components of the tip ends of the projections of the first electrode 92 and the second electrode 93 to move to the origins of the electrodes as the lighting time thereof elapses, and accordingly, the distance between the electrode tip ends of the first electrode 92 and the second electrode further increases. Since the discharge lamp lighting device 10 performs constant power driving, the driving current I decreases as the distance between the electrode tip ends increases. Accordingly, the fusibility of the electrode projections decreases, whereby the light emitting characteristics of the discharge lamp 90 are degraded, and a phenomenon such as flicker may easily occur.

When the degraded state of the first electrode 92 and the second electrode 93 of the discharge lamp 90 progresses, the distance between the first electrode 92 and the second electrode 93 (inter-electrode distance) increases. As the inter-electrode distance increases, the driving voltage Vla increases. In other words, the driving voltage Vla increases in accordance with the progress in the degraded state.

Thus, in this embodiment, for example, a driving voltage Vla of 100 V is set as a threshold value, the threshold value is compared with a detected driving voltage Vla, and the control unit 40 controls the discharge lamp driving section so as to change the driving conditions of the discharge lamp 90.

TABLE 2

| Lamp Voltage | D1-1 Time (ms) | A1-1 Frequency (Hz), Number of cycles | D1-2 Time (ms) | A1-2 Frequency (Hz), Number of cycles | D1-3 Time (ms) | A1-3 Frequency (Hz), Number of cycles |
|---|---|---|---|---|---|---|
| Lower Than 100 V | 7.7 | 95, 5 | 4.8 | 165, 5 | 3.7 | 220, 5 |
| Equal to or Higher Than 100 V | 7.7 | 105, 5 | 4.8 | 165, 4 | 3.7 | 220, 8 |

Table 2 shows an exemplary table of driving conditions, which are stored in the storage section 44, for a DC driving processing period of the first interval and an AC driving processing period of the first interval, and is an example of combining a driving voltage Vla, DC driving periods of the first-interval first to first-interval third DC driving processes D1-1, D1-2, and D1-3, and the frequency of each AC current of the first-interval first to first-interval third AC driving processes A1-1, A1-2, and A1-3, and the number of cycles of the AC current.

In the example shown in Table 2, in a case where the voltage detecting section 60 detects that the driving voltage Vla becomes equal to or higher than 100 V as a threshold value from lower than 100 V, the control unit 40 changes the driving conditions of the first-interval first to first-interval third AC driving processes A1-1, A1-2, and A1-3 as below.

In the first-interval first AC driving process A1-1, the frequency of the supplied AC current is increased, and the number of cycles thereof is decreased. In other words, in a case where it is determined that the first and second electrodes 92 and 93 of the discharge lamp 90 have been degraded, the lowest frequency in the AC driving process of the first interval that is performed within one sub-interval 1 is increased, and the number of cycles thereof is decreased, so that the period during which an AC current having the lowest frequency is supplied to the discharge lamp 90 is shortened within one sub-interval 1.

In the first-interval second AC driving process A1-2, the frequency of the supplied AC current is not changed, but the number of cycles thereof is decreased so as to shorten the length of the period.

In the first-interval third AC driving process A1-3, the frequency of the supplied AC current is not changed, but the number of cycles thereof is increased. In other words, in a case where it is determined that the first and second electrodes 92 and 93 of the discharge lamp 90 have been degraded, a period during which a highest frequency is supplied in the AC driving process of the first interval that is performed within one sub-interval is lengthened.

The driving conditions of each of the first-interval first to first-interval third DC driving processes D1-1, D1-2, and D1-3 are not changed in accordance with the value of the driving voltage Vla.

In addition, a table of the driving conditions for the DC driving processing period of the second interval and the AC driving processing period of the second interval is also stored in the storage section 44, similarly to that of the first interval. In the driving conditions, the polarity of the driving current I supplied to the discharge lamp 90 is opposite to that of the first interval, but the supply time of the DC current and the frequency and the number of cycles of the AC current in the second interval are the same as the supply time of the DC current in the first-interval first to first-interval third DC driving processes D1-1, D1-2, and D1-3 and the frequency and the number of cycles of the AC current in the first-interval first to first-interval third AC driving processes A1-1, A1-2, and A1-3.

Regarding the table of the driving condition, in a case where at least one of the period during which the first-interval first to first-interval third AC driving processes A1-1, A1-2, and A1-3 are performed and the period during which the second-interval first to second-interval third AC driving processes A2-1, A2-2, and A2-3 are performed is changed, another table of the driving conditions may be employed.

In the example shown in Table 2, the lengths of both the period during which the first-interval first and the first-interval second AC driving processes A1-1 and A1-2 are performed and the period during which the second-interval first and second-interval second AC driving processes A2-1 and A2-2 are performed are shortened, and the lengths of both the period during which the first-interval third AC driving process A1-3 is performed and the period during which the second-interval third AC driving process A2-3 is performed is lengthened. In other words, within one sub-interval 1, the period is controlled to be shortened by increasing the lowest frequency in the AC driving and decreasing the number of cycles at the lowest frequency, and the period is controlled to be lengthened by increasing the number of cycles at the highest frequency. In addition, the circuit configuration and the control of the initial polarity, the number of repetitions of intervals, and the like of a discharge lamp lighting device 10 according to the second embodiment are the same as those of the discharge lamp lighting device 10 according to the first embodiment.

Figure 8:
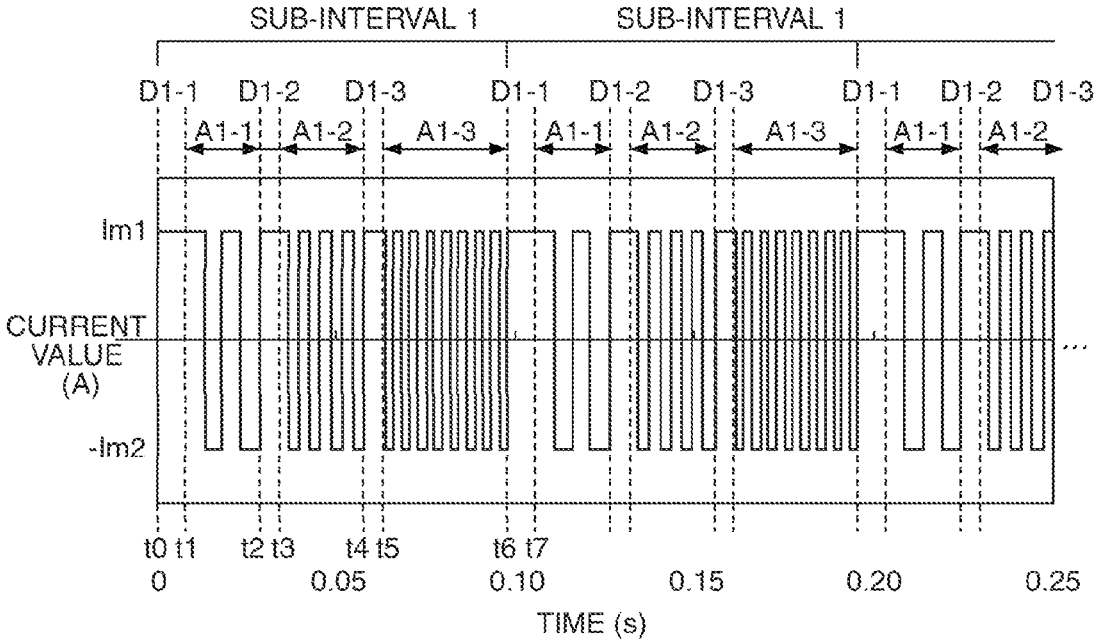
FIG. 8 is a timing diagram showing an example of the waveform of a driving current in a first interval according to a second embodiment.

FIG. 8 is a timing diagram of a driving current I flowing through the first electrode 92 in a case where the driving voltage Vla of the discharge lamp 90 exceeds 100 V. The conditions of the driving current I flowing through the first electrode 92 in a case where the driving voltage Vla of the discharge lamp 90 is lower than 100 V are the same as those of the first embodiment, and thus the timing diagram of the driving current I corresponds to FIG. 7A. Although the DC driving process of the first interval shown in FIG. 8 is the same as that of the first interval shown in FIG. 7A, the frequency of the AC current in the AC driving process of the first interval that is shown in FIG. 8 is higher than that in the AC driving process of the first interval shown in FIG. 7A, and the number of cycles increases from the AC driving process A1-1 toward the AC driving process A1-2 and the AC driving process A1-3, in other words, the driving process is performed so as to increase the period in that order.

Thus, in the example shown in Table 2, 100 V is used as a threshold value of the driving voltage Vla, and, in a case where the driving voltage Vla is lower than 100 V, the driving process is performed such that the period decreases in the order of the AC driving processes A1-1, A1-2, and A1-3 of the first interval within one sub-interval 1. On the other hand, in a case where the driving voltage Vla is equal to or higher than 100 V, the driving process is performed such that the period increases in the order of the AC driving processes A1-1, A1-2, and A1-3 of the first interval within one sub-interval 1. The AC driving process of the second interval is similarly changed.

Figure 9:
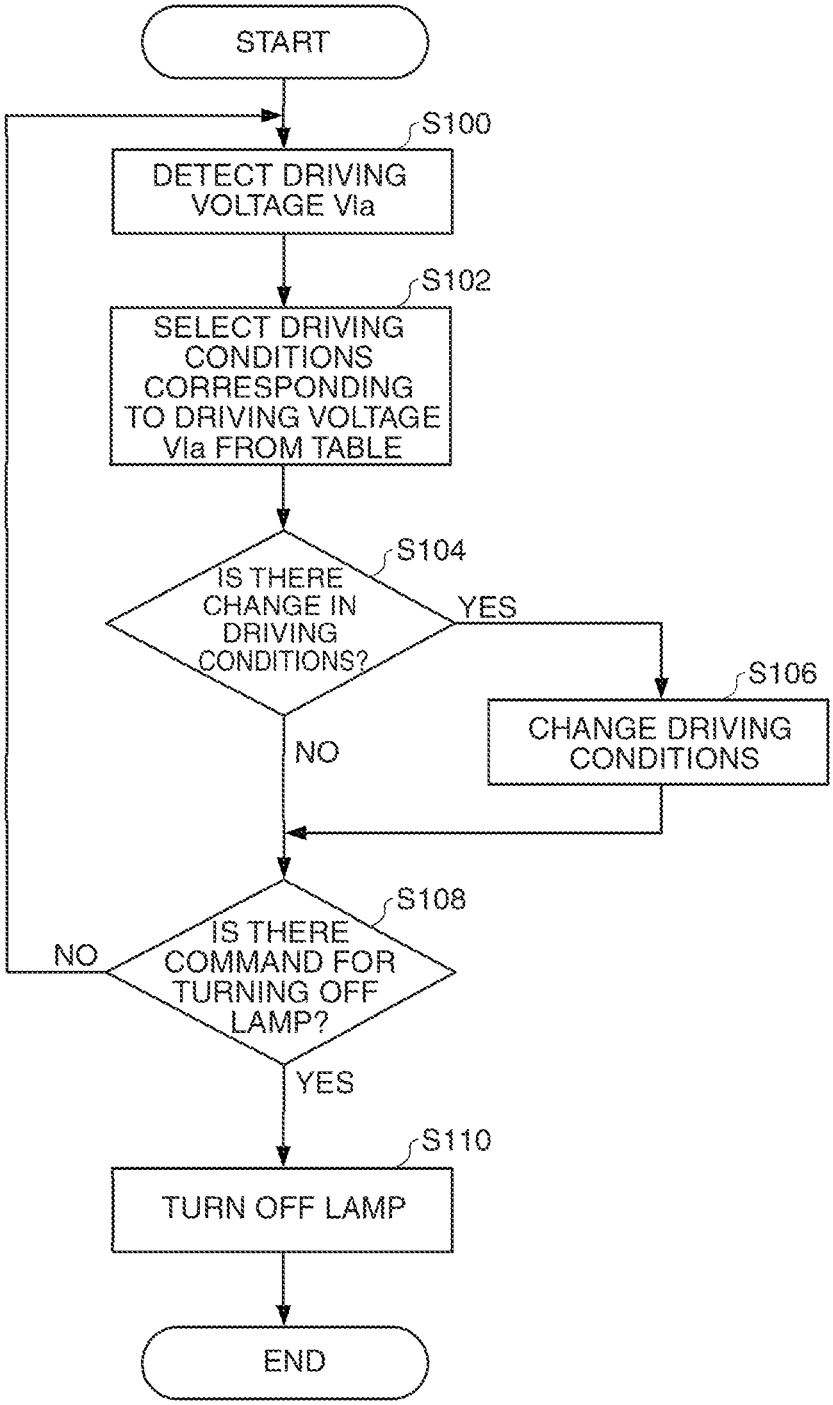
FIG. 9 is a flowchart showing an example of control of a discharge lamp lighting device according to the second embodiment.

FIG. 9 is a flowchart showing an example of the control process of the discharge lamp lighting device 10 according to the second embodiment. In the flowchart shown in FIG. 9, the control process until the discharge lamp 90 is turned off after being stably lit.

First, the voltage detecting section 60 detects a driving voltage Vla (Step S100). Next, the control unit 40 selects the driving conditions corresponding to the driving voltage Vla detected in Step S100 from the table that is stored in the storage section 44 (Step S102).

After the driving conditions are selected in Step S102 shown in FIG. 9, the control unit 40 determines whether or not the driving conditions need to be changed (Step S104). In a case where the control unit 40 determines that the driving conditions need to be changed (in the case of "Yes" in Step S104), the driving conditions are changed to the driving conditions selected in Step S102 so as to drive the discharge lamp 90 (Step S106). On the other hand, in a case where the control unit 40 determines that the driving conditions do not need to be changed (in the case of "No" in Step S104), the discharge lamp 90 is continuously driven with the previous driving conditions.

In the case of "No" in Step S104 and after Step S106, the control unit 40 determines whether or not there is any command for turning off the discharge lamp 90 (Step S108). In a case where it is determined that there is a command for turning off the discharge lamp 90 (in the case of "Yes" in Step S108), the control unit 40 ends the lighting (turning off) of the discharge lamp 90. On the other hand, in a case where it is determined that there is no command for turning off the discharge lamp 90 (in the case of "No" in Step S108), the control unit 40 repeats the control process of Steps S100 to S108 until there is a command for turning off the discharge lamp 90.

In the discharge lamp lighting device 10 according to the second embodiment, when the voltage detecting section 60 detects that the driving voltage Vla becomes 100 V or higher in accordance with an increase in the driving voltage Vla (the progress of the degraded states of the first electrode 92 and the second electrode 93), the control unit 40 changes in time the length of at least one of the period during which the AC driving process of the first interval is performed and the period during which the AC driving process of the second interval is performed based on Table 2. The lengths of both the period during which the first-interval first and first-interval second AC driving processes A1-1 and A1-2, in which an AC current having a relatively low frequency is supplied, are performed within one sub-interval 1 and the period during which the second-interval first and second-interval second AC driving processes A2-1 and A2-2, in which an AC current having a relatively low frequency is supplied, are performed within one sub-interval 2 are shortened, and the lengths of both the period during which the first-interval third AC driving process A1-3, in which an AC current having a relatively high frequency is supplied, within one sub-interval 1 is performed and the period during which the second-interval third AC driving process A2-3, in which an AC current having a relatively high frequency is supplied, is performed within one sub-interval 2 are lengthened. Accordingly, even in an electrode that cannot be easily fused in accordance with the progress of the degraded states of the first electrode 92 and the second electrode 93 included in the discharge lamp 90, projections can be formed stepwise. Therefore, the deformation of the first electrode 92 and the second electrode 93 of the discharge lamp 90 or the flicker can be suppressed.

When an AC driving process having a relatively long period is performed with a low frequency as the fusibility of the electrode projections reduces, the projection is flattened, and a flicker phenomenon may easily occur. However, by lengthening the period of the first-interval third AC driving process A1-3 that is an AC driving process, in which an AC current having a relatively high frequency is supplied, within one sub-interval 1, the projection can be acquired over a long period.

In addition, in the above-described example, although the threshold value used for changing the driving conditions is set to 100 V of the driving voltage Vla, the threshold value is not limited thereto, and another threshold value according to the characteristics of the discharge lamp 90 may be used. In addition, one threshold value and two types of the driving conditions are used in Table 2, a plurality of threshold values and a plurality of driving conditions corresponding thereto may be used. Furthermore, the period of the used DC driving process and the frequency and the number of cycles of the AC driving process may be appropriately set in accordance with the characteristics of the discharge lamp 90.

Furthermore, in this embodiment, as a detection value of the degradation of the first electrode 92 and the second electrode 93 of the discharge lamp 90, the driving voltage Vla of the lamp is used. However, other than that, accumulated lighting time, the degradation of the light emission intensity, a change in the driving voltage Vla or the intensity of illumination due to an arc jump or the like, or the like may be detected so as to determine the degradation.

4. Discharge Lamp Lighting Device According to Third Embodiment

Next, a specific example of control of a discharge lamp lighting device 10 according to a third embodiment will be described.

According to the third embodiment, the basic configuration of the discharge lamp lighting device 10 and the changing of the driving conditions for the period of each DC driving process and the period of each AC driving process in accordance with the progress of the degraded states of the first electrode 92 and the second electrode 93 of the discharge lamp 90 are the same as those of the second embodiment. However, in the discharge lamp lighting device according to the third embodiment, an example is shown in which a method of changing the driving conditions for each DC driving processing period and each AC driving processing period is different from that of the second embodiment. In the example presented below, in accordance with the progress of the degraded states of the first electrode 92 and the second electrode 93, the control unit 40, in a case where the DC driving processing period of the first interval is relatively long, performs an AC driving process of the first interval in which an AC current having a relatively high frequency is used in the AC driving performed thereafter, and, in a case where the period of the DC driving processing period of the first interval is relatively short, performs an AC driving process of the first interval in which an AC current having a relatively high frequency is used as the AC driving performed thereafter.

In other words, in the second embodiment, in accordance with the progress of the degraded states of the first electrode 92 and the second electrode 93, the control unit 40 performs control such that, after a DC driving period that is relatively long in the DC driving process of the first interval, an AC driving process using an AC current having a relatively low frequency among the AC driving processes of the first interval is performed. However, according to this embodiment, after the period of the DC driving process, which is relatively long, among the DC driving processes of the first interval, the control unit 40 performs control such that an AC driving process, which uses an AC current having a relatively high frequency, among the AC driving processes of the first interval is performed, which is different from the second embodiment. In addition, according to the third embodiment, the circuit configuration of the discharge lamp lighting device 10 and the control of the initial polarity, the number of repetitions of the intervals, and the like are similar to those of the discharge lamp lighting device 10 according to the second embodiment.

Although the lifespan of the discharge lamp 90 is enhanced by the units shown in the first embodiment, it is inevitable for the components of the tip ends of the projections of the first electrode 92 and the second electrode 93 to move to the origins of the electrodes as the lighting time thereof elapses, and accordingly, the distance between the electrode tip ends of the first electrode 92 and the second electrode further increases. Since the discharge lamp lighting device 10 performs constant power driving, the driving current I decreases as the distance between the electrode tip ends increases. Accordingly, the fusibility of the electrode projections decreases, whereby the light emitting characteristics of the discharge lamp 90 are degraded, and a phenomenon such as flicker may easily occur.

Thus, according to this embodiment, for example, a driving voltage Vla of 100 V is set as a threshold value, the threshold value is compared with a detected driving voltage Vla, and the progress of the degraded states of the first electrode 92 and the second electrode 93 of the discharge lamp 90 is detected. Then, in accordance with the progress of the degraded states, the period of each DC driving process and the period of each AC driving process are changed.

TABLE 3

| Lamp Voltage | D2-1 Time (ms) | A2-1 Frequency (Hz), Number of cycles | D2-2 Time (ms) | A2-2 Frequency (Hz), Number of cycles | D2-3 Time (ms) | A2-3 Frequency (Hz), Number of cycles |
|---|---|---|---|---|---|---|
| Lower Than 100 V | 7.7 | 95, 5 | 4.8 | 165, 5 | 3.7 | 220, 5 |
| Equal to or Higher Than 100 V | 7.7 | 220, 8 | 4.8 | 165, 4 | 3.7 | 105, 2 |

Table 3 shows an exemplary table of driving conditions, which are stored in the storage section 44, for the period of a DC driving process of the first interval and the period of an AC driving process of the first interval, and is an example of combining a driving voltage Vla, DC driving periods of the first-interval first to first-interval third DC driving processes D1-1, D1-2, and D1-3, and the frequency of each AC current of the first-interval first to first-interval third AC driving processes A1-1, A1-2, and A1-3, and the number of cycles of the AC current.

In the example of control parameters of the driving conditions shown in Table 3, in a case where the driving voltage Vla is lower than 100 V, the DC driving processes and the AC driving processes are controlled similarly to the first and second embodiments. However, in a case where the driving voltage Vla is equal to or higher than 100 V, the control parameters of the driving conditions of the AC driving processes are different from those of the second embodiment. In other words, in a case where the driving voltage Vla is equal to or higher than 100 V, while the frequency of the first AC current used in the AC driving process of the first interval is not changed in one sub-interval 1, the driving process is performed such that the frequency of the first AC current in the AC driving processes of the first interval is changed in time from a relatively high frequency to a relatively low frequency as the AC driving process changes from A1-1 to A1-2 and A1-3. In addition, similarly to the second embodiment, the period of an AC driving process having a higher frequency becomes longer. In other words, in accordance with the AC driving process changing from A1-1 to A1-2 and A1-3, the period of the AC driving process is shortened.

In other words, in a case where the driving voltage Vla is lower than 100 V, in one sub-interval 1, the frequency of the AC current supplied to the AC driving process of the first interval becomes higher in a stepped manner in the order of performance of the first-interval first to first-interval third AC driving processes A1-1, A1-2, and A1-3. On the other hand, in a case where the driving voltage Vla is equal to or higher than 100 V, the control unit 40 controls the discharge lamp driving section such that the lowest frequency in the AC driving process of the first interval performed within one sub-interval 1 is increased, and the frequency of the AC current supplied in the AC driving process of the first interval is decreased in a stepped manner within one sub-interval 1 in the order of performance of the first-interval first to first-interval third AC driving processes A1-1, A1-2, and A1-3.

In addition, in a case where the driving voltage Vla is lower than 100 V, within one sub-interval 1, the number of cycles of the AC current supplied in the AC driving process of the first interval is the same, and is shortened as the frequency is increased within the AC driving process of the first interval. On the other hand, in a case where the driving voltage Vla is equal to or higher than 100 V, the control unit 40 controls the discharge lamp driving section such that, within one sub-interval 1, the number of cycles of the AC current supplied in the AC driving process of the first interval is increased as the frequency of the AC current becomes higher, and the period of the AC driving process of the first interval having a higher frequency becomes longer.

Described in more detail, in the example shown in Table 3, in a case where the voltage detecting section 60 detects that the driving voltage Vla changes from being lower than 100 V as a threshold value to being equal to or higher than 100 V, the control unit 40 changes the driving conditions of the first-interval first to first-interval third AC driving processes A1-1, A1-2, and A1-3 as below.

In the first AC driving process A1-1 of the first interval, in a case where the driving voltage Vla is lower than 100 V as the threshold value, an AC current having a lowest AC frequency among the AC frequencies used in the AC driving processes is supplied. On the other hand, in a case where the driving voltage Vla is equal to or higher than 100 V as the threshold value, an AC current having a highest AC frequency among the AC frequencies used in the AC driving processes is supplied so as to increase the number of cycles. As a result, the period of the AC driving process having the highest AC frequency in a case where the driving voltage Vla is equal to or higher than 100 V is longer than the period of the AC driving process having the highest AC frequency in a case where the driving voltage Vla is lower than 100 V as the threshold value.

In the second AC driving process A1-2 of the first interval, although the frequency of the AC current that is supplied is not changed between a case where the driving voltage Vla is lower than 100 V as the threshold value and a case where the driving voltage Vla is equal to or higher than 100 V, the number of cycles thereof is decreased so as to shorten the length of the period.

In the third AC driving process A1-3 of the first interval, in a case where the driving voltage Vla is lower than 100 V as the threshold value, an AC current having the highest AC frequency of the AC frequencies used in the AC driving processes is supplied. On the other hand, in a case where the driving voltage Vla is equal to or higher than 100 V, an AC current having the lowest AC frequency among the AC frequencies used in the AC driving processes is supplied so as to decrease the number of cycles thereof. As a result, the period of the AC driving process having the lowest AC frequency in a case where the driving voltage Vla is equal to or higher than 100 V as the threshold value is shorter than the period of the AC driving process having the lowest AC frequency in a case where the driving voltage Vla is lower than 100 V as the threshold value.

In addition, a table of the driving conditions for the DC driving processing period of the second interval and the AC driving processing period of the second interval is also stored in the storage section 44, similarly to that of the first interval. In the driving conditions, the polarity of the driving current I supplied to the discharge lamp 90 is opposite to that of the first interval, but the supply time of the DC current and the frequency and the number of cycles of the AC current in the second interval are the same as the supply time of the DC current in the first-interval first to first-interval third DC driving processes D1-1, D1-2, and D1-3 and the frequency and the number of cycles of the AC current in the first-interval first to first-interval third AC driving processes A1-1, A1-2, and A1-3.

Figure 10:
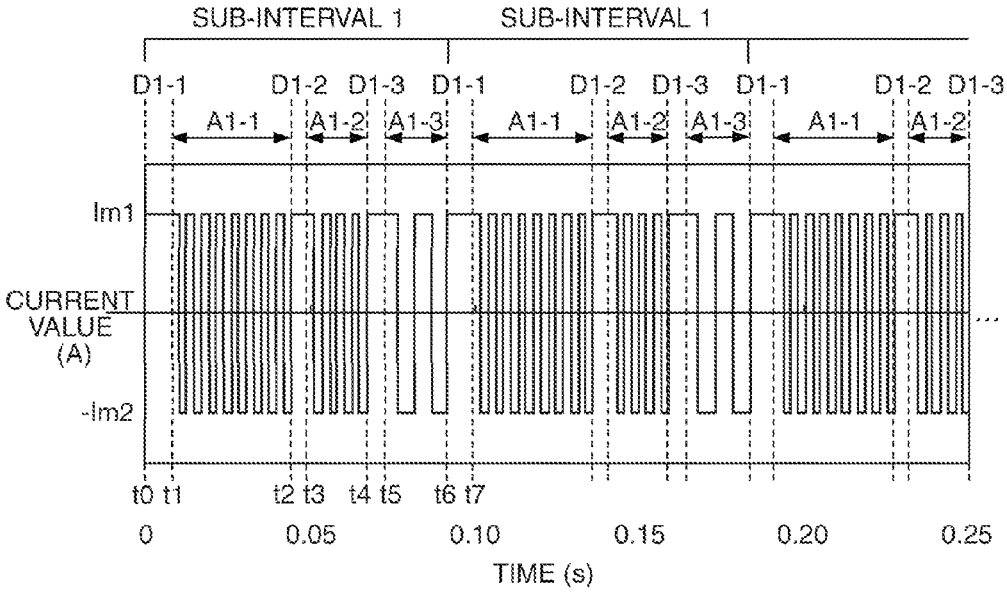
FIG. 10 is a timing diagram showing an example of the waveform of a driving current in a first interval according to a third embodiment.

FIG. 10 is a timing diagram of a driving current I flowing through the first electrode 92 in a case where the driving voltage Vla of the discharge lamp 90 exceeds 100 V. The conditions of the driving current I flowing through the first electrode 92 in a case where the driving voltage Vla of the discharge lamp 90 is lower than 100 V are the same as those of the first embodiment, and thus the timing diagram of the driving current I corresponds to FIG. 7A.

Here, the driving waveforms according to the second embodiment and this embodiment in a case where the driving voltage Vla is equal to or higher than 100 V will be compared with each other. In this embodiment shown in FIG. 10 and the second embodiment shown in FIG. 8, the first-interval first to first-interval third DC driving processes D1-1, D1-2, and D1-3 is the same. However, in the first-interval first to first-interval third AC driving processes A1-1, A1-2, and A1-3, while the AC frequency is increased in the order of the first-interval first to first-interval third AC driving processes A1-1, A1-2, and A1-3 according to the second embodiment shown in FIG. 8, the driving process is performed such that the AC frequency is decreased in the order of the first-interval first to first-interval third AC driving processes A1-1, A1-2, and A1-3 according to this embodiment. In other words, as the periods of the first-interval first to first-interval third DC driving processes D1-1, D1-2, and D1-3 are shortened in this order, the frequencies in the periods of the first-interval first to first-interval third AC driving processes A1-1, A1-2, and A1-3 performed after the DC driving processes are decreased in this order. In this embodiment, the number of cycles corresponding to each frequency is the same as that of the second embodiment.

As the degraded states of the first electrode 92 and the second electrode 93 of the discharge lamp 90 progress, and the fusibility of the electrode projections decreases, in a case where an AC driving process is performed with a low frequency for a relatively long time, the projections are flattened, and a flicker phenomenon may easily occur. In such a case, in a case where the period of the DC driving process is long, the tip end portion of the electrode serving as anode can be effectively acquired in the period of the DC driving process, and a state is formed in which flicker can more easily occur in the tip end portion of one electrode serving as cathode.

On the contrary, according to this embodiment, in a case where the progress of the degraded states of the first electrode 92 and the second electrode 93 of the discharge lamp 90 is detected by checking that the driving voltage Vla exceeds 100 V, after the period of the first-interval first DC driving process D1-1 in which a DC current that is relatively long among the DC driving processes is supplied to the discharge lamp 90, the period of the first-interval first AC driving process A1-1 in which an AC current having a relatively high frequency among the AC driving processes is lengthened. Accordingly, the flicker phenomenon of the cathode-side electrode can be suppressed.

In addition, in the anode-side electrode, the tip end of the electrode is fused during the period of the first-interval first DC driving process D1-1 in which a DC current is supplied to the discharge lamp 90 for the longest period among the DC driving process, and thereafter, the discharge lamp 90 is driven by being supplied with an AC current having a high frequency during the first-interval first AC driving process A1-1, whereby the calescence point of the arc is maintained. Next, after the first-interval second and the first-interval third DC driving processes D1-2 and D1-3 of which periods are shorter than that of the first-interval first DC driving process D1-1, the discharge lamp 90 is driven in the first-interval second and first-interval third AC driving processes A1-2 and A1-3 in which an AC current having frequencies lower than that of the first-interval first AC driving process A1-1 is supplied to the discharge lamp 90, whereby large projections are formed, and relatively robust projections can be maintained.

In addition, the control unit 40 may control the discharge lamp driving section such that, in a case where the driving voltage Vla is equal to or higher than 100 V, the discharge lamp 90 is driven under the driving conditions applied in a case where the driving voltage Vla is equal to or higher than 100 V that has been described in the second embodiment, and in a case where the driving voltage Vla further increases and, for example, is equal to or higher than 110 V, the discharge lamp 90 is driven under the driving conditions of this embodiment that are applied in a case where the driving voltage Vla is equal to or higher than 100 V.

5. Discharge Lamp Lighting Device According to Fourth Embodiment

Next, a specific example of control of a discharge lamp lighting device 10 according to a fourth embodiment will be described.

According to the fourth embodiment, the basic configuration of the discharge lamp lighting device 10 and the method of changing the period of each DC driving process, the period of each AC driving process, and the frequency according to the third embodiment are the same. However, as a modified example of the third embodiment, in addition to Table 3 representing the third embodiment, as is further shown in Table 4, an example is shown in which the period of each DC driving process and the number of cycles and the frequency of the AC current in the period of each AC driving process are controlled to be changed in a case where the driving voltage Vla is equal to or higher than 120 V. In addition, the circuit configuration and other control operations of the discharge lamp lighting device 10 according to the fourth embodiment are the same as those of the discharge lamp lighting device 10 according to the third embodiment.

According to this embodiment, similarly to the third embodiment, a driving voltage Vla of 100 V is set as a first threshold value, the first threshold value is compared with a detected driving voltage Vla, and the progress of the degraded states of the first electrode 92 and the second electrode 93 of the discharge lamp 90 are detected. Then, in accordance with the progress of the degraded states, the driving conditions of the AC driving process of the first interval and the AC driving process of the second interval are changed. Accordingly, although the lifespan of the discharge lamp 90 is improved, the degraded states of the first electrode 92 and the second electrode 93 of the discharge lamp 90 further progress in accordance with the elapse of the lighting time of the first electrode 92 and the second electrode 93. Thus, when the distance between the electrodes increases, and the driving voltage Vla increases further, the discharge lamp lighting device 10 performs constant power driving, and whereby the driving current I decreases, and the fusibility of the projections of the electrode reduces. Therefore, it is more difficult to maintain the tip ends of the electrodes in a good condition.

Thus, in this embodiment, for example, 120 V of the driving voltage Vla is set as a second threshold value, the second threshold value is compared with the detected driving voltage Vla, and the control unit 40 controls the discharge lamp driving section such that the driving conditions of the discharge lamp 90 are further changed.

TABLE 4

| Lamp Voltage | D2-1 Time (ms) | A2-1 Frequency (Hz), Number of cycles | D2-2 Time (ms) | A2-2 Frequency (Hz), Number of cycles | D2-3 Time (ms) | A2-3 Frequency (Hz), Number of cycles |
|---|---|---|---|---|---|---|
| Lower Than 100 V | 7.7 | 95, 5 | 4.8 | 165, 5 | 3.7 | 220, 5 |
| Equal to or Higher Than 100 V and lower than 120 V | 7.7 | 220, 8 | 4.8 | 165, 4 | 3.7 | 105, 2 |
| Equal to or Higher than 120 V | 11.1 | 280, 16 | 6.0 | 165, 4 | 3.0 | 135, 2 |

Table 4 shows an exemplary table of driving conditions, which are stored in the storage section 44, for the period of a DC driving process of the first interval and the period of an AC driving process of the first interval, and is an example of combining a driving voltage Vla, DC driving periods of the first-interval first to first-interval third DC driving processes D1-1, D1-2, and D1-3, and the frequency of each AC current of the first-interval first to first-interval third AC driving processes A1-1, A1-2, and A1-3, and the number of cycles of the AC current.

In this embodiment, as an example shown in Table 4, for example, 120 V is set as the second threshold value. While the driving process is performed similarly to the third embodiment in a case where the driving voltage Vla is lower than 120 V, the driving conditions of the DC driving process and the AC driving process are further changed in a case where the driving voltage Vla is equal to or higher than 120 V.

In the example shown in Table 4, in a case where the voltage detecting section 60 detects that the driving voltage Vla changes from being lower than 120 V as the second threshold value to being equal to or higher than 120 V, the control unit 40 changes the driving conditions of the first-interval first to first-interval third AC driving processes A1-1, A1-2, and A1-3 as below.

Figure 11:
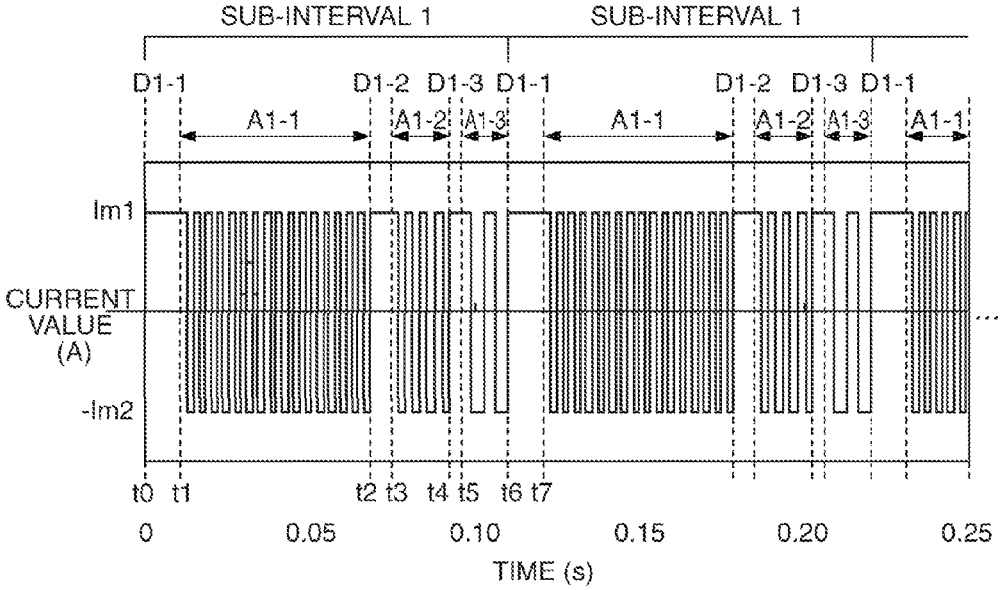
FIG. 11 is a timing diagram showing an example of the waveform of a driving current in a first interval, according to a fourth embodiment.

FIG. 11 is a timing diagram of a driving current I flowing through the first electrode 92 in a case where the driving voltage Vla of the discharge lamp 90 exceeds 120 V. The conditions of the driving current I flowing through the first electrode 92 in a case where the driving voltage Vla of the discharge lamp 90 is lower than 100 V are the same as those of the first embodiment, and thus the timing diagram of the driving current I corresponds to FIG. 7A. The conditions for the driving current I flowing through the first electrode 92 in a case where the driving voltage Vla of the discharge lamp 90 is equal to or higher than 100 V and lower than 120 C are the same as those of the second embodiment in a case where the driving voltage Vla is equal to or higher than 100 V, and the timing diagram of the driving current I corresponds to FIG. 10.

A driving waveform in a case where the driving voltage Vla is equal to or higher than 120 V as the second threshold value and a driving waveform in a case where the driving voltage Vla is equal to or higher than 100 V as the first threshold value and is lower than 120 V as the second threshold value will be compared with each other with reference to FIGS. 10 and 11 and Table 4.

In a case where the driving voltage Vla is equal to or higher than 120 V, periods during which the DC current is supplied to the discharge lamp 90 in the first-interval first DC driving process D1-1 and the first-interval second DC driving process D1-2 are lengthened from 7.7 ms to 11.1 ms and 4.8 ms to 6.0 ms from a case where the driving voltage Vla is lower than 120 V, and the period of the first-interval third DC driving process D1-3 is shortened from 3.7 ms to 3.0 ms.

In a case where the driving voltage Vla is equal to or higher than 120 V, in the first-interval first AC driving process A1-1, the frequency of the AC current supplied to the discharge lamp 90 is increased from 220 Hz to 280 Hz, and the number of cycles is increased from 8 cycles to 16 cycles as twice thereof from a case where the driving voltage Vla is lower than 120 V. In a case where the driving voltage Vla is equal to or higher than 120 V, in the first-interval third AC driving process A1-3, the number of cycles of the AC current supplied to the discharge lamp 90 does not change but the frequency thereof is increased compared to a case where the driving voltage Vla is lower than 120 V. In the first-interval second AC driving process A1-2, the driving conditions are not changed even in a case where the driving voltage Vla is equal to or higher than 120 V.

As a result, in the first-interval DC driving process, the longest period during which a DC current is supplied in the DC driving processes of the first interval in a case where the driving voltage Vla is equal to or higher than 120 V as the second threshold value is longer than the longest period during which a DC current is supplied in the DC driving processes of the first interval in a case where the driving voltage Vla is lower than 120 V as the second threshold value, and the shortest period during which a DC current is supplied in the DC driving processes of the first interval in a case where the driving voltage Vla is equal to or higher than 120 V as the second threshold value is shorter than the shortest period during which a DC current is supplied in the DC driving processes of the first interval in a case where the driving voltage Vla is lower than 120 V as the second threshold value.

In the AC driving process of the first interval, a highest frequency of a first AC current supplied in the AC driving processes of the second interval in a case where the driving voltage Vla is equal to or higher than 120 V as the second threshold value is higher than a highest frequency of a first AC current supplied in the AC driving processes of the first interval in a case where the driving voltage Vla is lower than 120 V as the second threshold value, and a lowest frequency of a first AC current supplied in the AC driving processes of the first interval in a case where the driving voltage Vla is equal to or higher than 120 V as the second threshold value is higher than a lowest frequency of a first AC current supplied in the AC driving processes of the first interval in a case where the driving voltage Vla is lower than 120 V as the second threshold value.

The period during which a DC current is supplied in the DC driving processes of the first interval within one sub-interval 1 is shortened in the order of performance of the first-interval first to first-interval third DC driving processes D1-1, D1-2, and D1-3 in a stepped manner. In addition, the frequency of an AC current supplied in the AC driving processes of the first interval within one sub-interval 1 is decreased in the order of performance of the first-interval first to first-interval third AC driving processes A1-1, A1-2, and A1-3 in a stepped manner.

As a result of the changes in the driving conditions, after the first-interval first DC driving process D1-1 as the longest DC driving process that has been lengthened, the first-interval first AC driving process A1-1 as an AC driving process in which an AC current having the highest frequency that has been further increased and having an increased number of cycles is supplied is performed. In addition, after the first-interval third DC driving process D1-3 as the shortest DC driving process that has been further shortened, the first-interval third AC driving process A1-3 as an AC driving process in which an AC current, which has been pulled up, having the lowest frequency is supplied is performed.

In addition, a table of the driving conditions for the DC driving processing period of the second interval and the AC driving processing period of the second interval is also stored in the storage section 44, similarly to that of the first interval. In the driving conditions, the polarity of the driving current I supplied to the discharge lamp 90 is opposite to that of the first interval, but the supply time of the DC current and the frequency and the number of cycles of the AC current in the second interval are the same as the supply time of the DC current in the first-interval first to first-interval third DC driving processes D1-1, D1-2, and D1-3 and the frequency and the number of cycles of the AC current in the first-interval first to first-interval third AC driving processes A1-1, A1-2, and A1-3.

In a state in which the degraded states of the first electrode 92 and the second electrode 93 of the discharge lamp further progress, the distance between the electrodes increases, and the driving voltage Vla is further increased, the fusibility of the tip end of the electrode is in a state of being further decreased. Accordingly, in order to maintain projections well, the parameters of the driving conditions in a case where the driving voltage Vla shown in Table 2 of the third embodiment is equal to or higher than 100 V need to be further changed.

In this embodiment, in a case where the driving voltage Vla is increased, for example, to be equal to or higher than 120 V, it is effective to acquire projections by setting the period during which a DC current is supplied to the discharge lamp 90 in the period of the first-interval first DC driving process D1-1 to be longer than that in a case where the driving voltage Vla is lower than 120 V so as to increase the fusibility of the tip end of the electrode and increasing the frequency of an AC current supplied to the discharge lamp 90 during the first-interval first AC driving process A1-1 performed thereafter so as to increase the number of cycles.

Even in a case where the driving voltage Vla is further lowered, for example, as being lower than 120 V, by increasing a difference used for shortening the lengths of periods of the first-interval first to first-interval third DC driving processes D1-1, D1-2, and D1-3 in this order in a stepped manner so as to limit the fused portion and increasing the frequency during a period of the AC driving process, in which an AC current having the lowest frequency is supplied, among the first-interval first to first-interval third AC driving processes A1-1, A1-2, and A1-3 so as to allow the projections to be appropriately large, the flicker phenomenon or the problem of movement of the projections due to a decrease in the size of the projections can be suppressed. As above, by changing the driving control in accordance with a difference in the fusibility of the tip end of the electrode that is accompanied with the degradation, the projections can be maintained more effectively.

In addition, in this embodiment, during the period of the first-interval first AC driving process A1-3 that uses the lowest frequency among the AC driving processes, in a case where the driving voltage Vla becomes equal to or higher than 120 V from a case where the driving voltage Vla is lower than 120 V, the driving conditions are changed such that the frequency is increased without changing the number of cycles. However, at least one of a change in the driving conditions for increasing the lowest frequency and a change in the driving conditions for decreasing the number of cycles of the AC current having the lowest frequency may be applied.

6. Circuit Configuration of Projector

Figure 12:
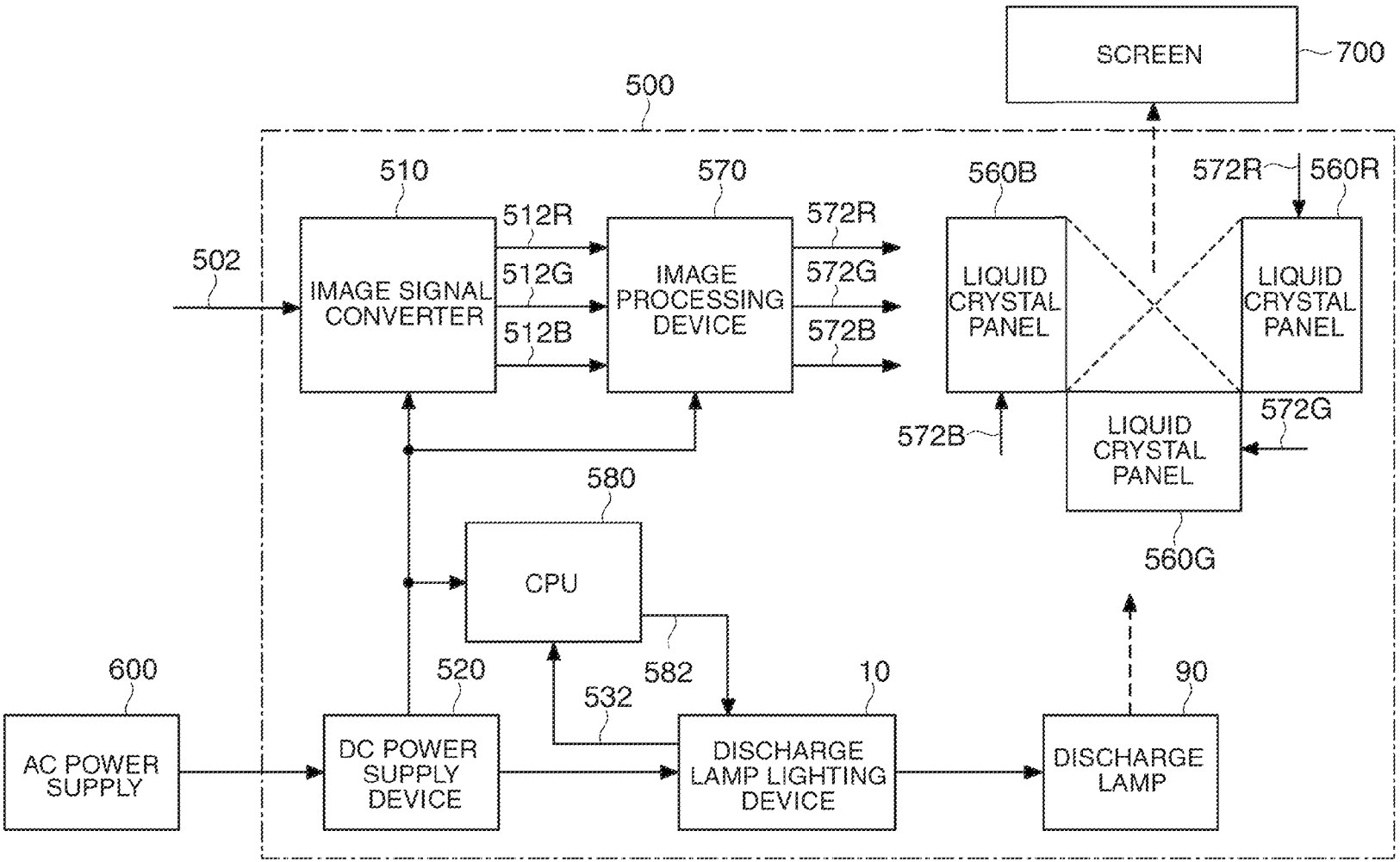
FIG. 12 is a diagram showing an example of the circuit configuration of a projector according to an embodiment of the disclosure.

FIG. 12 is a diagram showing an example of the circuit configuration of the projector according to this embodiment.

The projector 500 includes not only the above-described optical system but also an image signal converter 510, a DC power supply device 520, the discharge lamp lighting device 10, the discharge lamp 90, the liquid crystal panels 560R, 560G, and 560B, and an image processor 570.

The image signal converter 510 generates image signals 512R, 512G, and 512B by converting an image signal 502 (for example, a luminance signal and a color difference signal or an analog RGB signal), which is input from the outside, into a digital RGB signal with a predetermined word length and then supplies the image signals 512R, 512G, and 512B to the image processor 570.

The image processor 570 performs image processing on the three image signals 512R, 512G, and 512B and outputs driving signals 572R, 572G, and 572B for driving the liquid crystal panels 560R, 560G, and 560B, respectively.

The DC power supply device 520 converts the AC voltage supplied from an external AC power supply 600 into the fixed DC voltage and then supplies the DC voltage to the image signal converter 510 located at the secondary side of a transformer (not shown but included in the DC power supply device 520), the image processor 570, and the discharge lamp lighting device 10 located at the primary side of the transformer.

At the start of the discharge lamp lighting device 10, the discharge lamp lighting device 10 generates a high voltage between electrodes of the discharge lamp 90 so that a discharge path is formed by dielectric breakdown. Then, the discharge lamp lighting device 10 supplies a driving current I for making the discharge lamp 90 keep the discharge.

The liquid crystal panels 560R, 560G, and 560B modulate the luminance of color light, which is incident on each liquid crystal panel through the optical system described previously, by the driving signals 572R, 572G, and 572B, respectively.

A CPU (Central Processing Unit) 580 controls an operation until the projector is turned off after the start of lighting in the projector. For example, a lighting command or a lights-out command may be output to the discharge lamp lighting device 10 through a communication signal 582. In addition, the CPU 580 may receive lighting information on the discharge lamp 90 from the discharge lamp lighting device 10 through a communication signal 532.

According to the projector 500 configured as described above, formation of steady convection currents inside the discharge lamp 90 is further suppressed, and accordingly biased consumption of the electrodes and biased deposition of electrode materials can be prevented.

In each of the above embodiments, the projector which uses three liquid crystal panels has been illustrated. However, the disclosure is not limited thereto and may also be applied to a projector which uses one, two, or four or more liquid crystal panels.

In each of the above embodiments, the transmissive projector has been illustrated. However, the disclosure is not limited thereto and may also be applied to a reflective projector. Here, 'transmissive' means that an electro-optical modulator as a light modulation unit is of a type in which light is transmitted therethrough like a transmissive liquid crystal panel, and 'reflective' means that an electro-optical modulator as a light modulation unit is of a type in which light is reflected therefrom like a reflective liquid crystal panel or a micromirror type modulator. As the micromirror type modulator, a DMD (digital micromirror device; trademark of Texas Instruments) may be used, for example. Also when the disclosure is applied to the reflective projector, the same effects as in the transmissive projector can be acquired.

The disclosure may be applied to both a front projection type projector, which projects a projected image from the observation side, and a rear projection type projector, which projects a projected image from the opposite side to the observation side.

In addition, the disclosure is not limited to the above-described embodiments, and various modifications may be made within the scope and spirit of the disclosure.

The disclosure includes substantially the same configuration (for example, a configuration with the same function, method, and result or a configuration with the same object and effect) as the configuration described in the embodiment. In addition, the disclosure includes a configuration which replaces a portion that is not essential in the configuration described in the embodiment. In addition, the disclosure includes a configuration capable of achieving the same operation and effect as in the configuration described in the embodiment or a configuration capable of achieving the same object. In addition, the disclosure includes a configuration in which a known technique is added to the configuration described in the embodiment.

For example, in the above embodiments, the AC current (rectangular wave AC current) which alternately repeats a period, for which a predetermined current value of the first polarity continues, and a period, for which a predetermined current value of the second polarity continues, has been described as an example of the alternating current supplied as the driving current I. However, the alternating current supplied as the driving current I may also be an AC current whose current value changes during a period for which the first polarity or the second polarity continues.

In addition, for example, in the driving conditions of the DC driving process of the first interval, the DC driving process of the second interval, the AC driving process of the first interval, and the AC driving process of the second interval, the duration of supply of a DC current, and the number of steps or the interval of steps for changing the frequency of the AC current and the number of cycles may be arbitrarily set in accordance with the specifications of the discharge lamp or the like. In addition, in the DC driving process of the first interval, the DC driving process of the second interval, the AC driving process of the first interval, and the AC driving process of the second interval, the duration of supply of a DC current, the frequency and the number of cycles of the AC current may be continuously changed in each step. Furthermore, the number of steps to be changed, the interval of the step, or the number of repetitions of the interval may be different in the first interval and the second interval. Therefore, it is manifestly intended that embodiments in accordance with the present disclosure be limited only by the claims and the equivalents thereof.

What is claimed is:

1. A discharge lamp lighting device comprising:

a discharge lamp driving section that drives a discharge lamp by supplying a driving current to the discharge lamp; and a control unit that controls the discharge lamp driving section, wherein the control unit alternately performs a first-interval DC driving process and a first-interval AC driving process in a first interval, alternately performs a second-interval DC driving process and a second-interval AC driving process in a second interval other than the first interval, controls a first DC current that is configured by a first polarity component starting from a first polarity so as to be supplied as the driving current in the first-interval DC driving process, controls a first AC current that repeats the first polarity component and a second polarity component so as to be supplied as the driving current in the first-interval AC driving process, controls a second DC current that is configured by the second polarity component starting from a second polarity so as to be supplied as the driving current in the second-interval DC driving process, controls a second AC current that repeats the first polarity component and the second polarity component so as to be supplied as the driving current in the second-interval AC driving process, and changes a length of at least one of a period during which the first-interval DC driving process is performed and a period during which the second-interval DC driving process is performed, so as to be shortened in a stepped manner within a predetermined sub-interval.

2. The discharge lamp lighting device according to claim 1, wherein the control unit changes a frequency of the first AC current or the second AC current within the predetermined sub-interval.

3. The discharge lamp lighting device according to claim 1, wherein the control unit changes a frequency of the first AC current or the second AC current so as to be increased relatively in a stepped manner in an order of performance of the first-interval AC driving process or the second-interval AC driving process within the predetermined sub-interval.

4. The discharge lamp lighting device according to claim 1, wherein the control unit changes a frequency of the first AC current or the second AC current from a relatively high frequency to a relatively low frequency in a stepped manner within the predetermined sub-interval in an order of performance of the first-interval AC driving process or the second-interval AC driving process in accordance with a degraded state of electrodes of the discharge lamp.

5. The discharge lamp lighting device according to claim 1, wherein the control unit changes a lowest frequency of at least one of the first AC current and the second AC current so as to be increased within the predetermined sub-interval in accordance with a degraded state of electrodes of the discharge lamp.

6. The discharge lamp lighting device according to claim 1, wherein the control unit changes a longest DC driving process period to be increased within the predetermined sub-interval in accordance with a degraded state of electrodes of the discharge lamp.

7. The discharge lamp lighting device according to claim 1, wherein the control unit changes a period during which the driving is performed at a lowest frequency of at least one of the first AC current and the second AC current so as to be decreased within the predetermined sub-interval in accordance with a degraded state of electrodes of the discharge lamp.

8. A projector comprising:

the discharge lamp lighting device according to claim 1.

9. A projector comprising:

the discharge lamp lighting device according to claim 2.

10. A projector comprising:

the discharge lamp lighting device according to claim 3.

11. A projector comprising:

the discharge lamp lighting device according to claim 4.

12. A projector comprising:

the discharge lamp lighting device according to claim 5.

13. A projector comprising:

the discharge lamp lighting device according to claim 6.

14. A projector comprising:

the discharge lamp lighting device according to claim 7.

15. A method of driving a discharge lamp by supplying a driving current to the discharge lamp, the method comprising:

alternately performing a first-interval DC driving process and a first-interval AC driving process in a first interval; and alternately performing a second-interval DC driving process and a second-interval AC driving process in a second interval other than the first interval, wherein a first DC current that is configured by a first polarity component starting from a first polarity is supplied as the driving current in the performing of the first-interval DC driving process, a first AC current that repeats the first polarity component and a second polarity component is supplied as the driving current in the performing of the first-interval AC driving process, a second DC current that is configured by the second polarity component starting from a second polarity is supplied as the driving current in the performing of the second-interval DC driving process, a second AC current that repeats the first polarity component and the second polarity component is supplied as the driving current in the performing of the second-interval AC driving process, a length of at least one of a period of the performing of the first-interval DC driving process and a period of the performing of the second-interval DC driving process is changed so as to be shortened in a stepped manner in an order of performance within a predetermined sub-interval, and a frequency of the first AC current or the second AC current is changed in the performing of the first-interval AC driving process or the performing of the second-interval AC driving process performed within the predetermined sub-interval.

* * * * *